US011179732B2

(12) United States Patent
Vijay

(10) Patent No.: US 11,179,732 B2
(45) Date of Patent: Nov. 23, 2021

(54) ELECTRODISCHARGE APPARATUS

(71) Applicant: VLN Advanced Technologies Inc., Ottawa (CA)

(72) Inventor: Mohan Vijay, Gloucester (CA)

(73) Assignee: VLN Advanced Technologies Inc., Ottawa (CA)

( * ) Notice: Subject to any disclaimer, the term of this patent is extended or adjusted under 35 U.S.C. 154(b) by 0 days.

(21) Appl. No.: 15/615,078

(22) Filed: Jun. 6, 2017

(65) Prior Publication Data

US 2017/0274394 A1 Sep. 28, 2017

Related U.S. Application Data

(60) Division of application No. 15/153,336, filed on May 12, 2016, now Pat. No. 9,770,724, which is a (Continued)

(51) Int. Cl.
*B05B 1/08* (2006.01)
*B05B 12/06* (2006.01)
(Continued)

(52) U.S. Cl.
CPC ..... *B05B 1/08* (2013.01); *B05B 12/06* (2013.01); *B05B 17/0676* (2013.01); *B08B 3/02* (2013.01);
(Continued)

(58) Field of Classification Search
CPC ..... B05B 1/08; B05B 5/087; B05B 5/1616; B05B 5/025; B05B 12/06; B08B 3/10; B08B 3/12
See application file for complete search history.

(56) References Cited

U.S. PATENT DOCUMENTS 2,936,791 A 5/1960 Farrar
3,141,296 A * 7/1964 Jacobs, Jr. ..... F03H 1/00 310/300
(Continued)

FOREIGN PATENT DOCUMENTS

CA 951749 7/1974
CA 2477775 9/2003
(Continued)

OTHER PUBLICATIONS

Vijay, M.M., Numerical Analysis of Pulsed Jet Formation by Electric Discharges in a Nozzle, 14th International Conference on Jetting Technology (Year: 1998).*
(Continued)

*Primary Examiner* — Alex M Valvis
*Assistant Examiner* — Christopher R Dandridge
(74) *Attorney, Agent, or Firm* — Getz Balich LLC

(57) ABSTRACT

An electrodischarge apparatus has a nozzle that includes a discharge chamber that has an inlet for receiving a liquid and an outlet. The apparatus has a first electrode extending into the discharge chamber that is electrically connected to one or more high-voltage capacitors. A second electrode is proximate to the first electrode to define a gap between the first and second electrodes. A switch causes the one or more capacitors to discharge across the gap between the electrodes to create a plasma bubble which expands to form a shockwave that escapes from the nozzle ahead of the plasma bubble.

9 Claims, 18 Drawing Sheets

Related U.S. Application Data continuation of application No. 14/741,101, filed on Jun. 16, 2015, now Pat. No. 10,226,776.

(60) Provisional application No. 62/150,356, filed on Apr. 21, 2015, provisional application No. 62/105,779, filed on Jan. 21, 2015.

(51) Int. Cl.

| | |
|---|---|
| ***B08B 9/00*** | (2006.01) |
| ***B08B 3/02*** | (2006.01) |
| ***B08B 3/12*** | (2006.01) |
| ***B05B 17/06*** | (2006.01) |
| ***B08B 3/10*** | (2006.01) |
| ***B08B 9/08*** | (2006.01) |
| *B05B 5/025* | (2006.01) |
| *B05B 5/08* | (2006.01) |
| *B05B 5/16* | (2006.01) |
| *E21C 45/00* | (2006.01) |

(52) U.S. Cl.

CPC ..... *B08B 3/10* (2013.01); *B08B 3/12* (2013.01); *B08B 9/0813* (2013.01); *B05B 5/025* (2013.01); *B05B 5/087* (2013.01); *B05B 5/1616* (2013.01); *B08B 9/00* (2013.01); *B08B 2203/0288* (2013.01); *E21C 45/00* (2013.01)

(56) References Cited

U.S. PATENT DOCUMENTS

| | | | | |
|---|---|---|---|---|
| 3,354,648 | A | 11/1967 | Jiro | |
| 3,364,708 | A | 1/1968 | Padberg | |
| 3,486,062 | A * | 12/1969 | Schrom | G10K 15/06 367/147 |
| 3,647,137 | A * | 3/1972 | Naydan | B02C 19/18 239/102.2 |
| 3,679,007 | A | 7/1972 | O'Hare | |
| 4,004,737 | A | 1/1977 | Aker et al. | |
| 4,905,673 | A | 3/1990 | Pimiskern | |
| 4,991,774 | A | 2/1991 | Kelly | |
| 5,106,164 | A | 4/1992 | Kitzinger et al. | |
| 5,120,657 | A | 6/1992 | McCabe et al. | |
| 5,368,724 | A * | 11/1994 | Ayers | A61L 2/14 204/663 |
| 5,452,639 | A | 9/1995 | Aulenbacher et al. | |
| 5,482,357 | A | 1/1996 | Wint et al. | |
| 5,630,915 | A | 5/1997 | Greene et al. | |
| 5,929,363 | A | 7/1999 | Neff et al. | |
| 5,948,704 | A | 9/1999 | Benjamin et al. | |
| 6,026,135 | A | 2/2000 | McFee et al. | |
| 6,120,818 | A * | 9/2000 | Long | A22C 9/002 426/234 |
| 6,217,531 | B1 | 4/2001 | Reitmajer | |
| 6,283,555 | B1 | 9/2001 | Arai et al. | |
| 6,343,534 | B1 | 2/2002 | Khanna et al. | |
| 6,455,808 | B1 | 9/2002 | Chung et al. | |
| 6,457,778 | B1 | 10/2002 | Chung et al. | |
| 6,606,932 | B2 | 8/2003 | Goldstein | |
| 6,972,421 | B2 | 12/2005 | Melnychuk et al. | |
| 7,162,943 | B1 | 1/2007 | Reitmeyer et al. | |
| 7,270,195 | B2 | 9/2007 | MacGregor et al. | |
| 7,594,614 | B2 | 9/2009 | Vijay | |
| 7,987,760 | B1 | 8/2011 | Lundquist et al. | |
| 8,063,813 | B1 | 11/2011 | Keller | |
| 8,297,540 | B1 | 10/2012 | Vijay | |
| 8,550,873 | B2 | 10/2013 | Vijay | |
| 8,683,907 | B1 | 4/2014 | Howe et al. | |
| 9,176,504 | B2 | 11/2015 | Chiou et al. | |
| 2005/0262995 | A1 | 12/2005 | Kilkis | |
| 2008/0156219 | A1 | 7/2008 | Voss et al. | |
| 2009/0071910 | A1 | 3/2009 | Ike | |
| 2009/0288550 | A1 | 11/2009 | Willner | |
| 2009/0326421 | A1 | 12/2009 | Schwarze | |
| 2010/0300335 | A1 | 12/2010 | Zhao et al. | |
| 2011/0120290 | A1 | 5/2011 | Bitar et al. | |
| 2011/0186657 | A1 | 8/2011 | Haviland | |
| 2012/0256013 | A1 * | 10/2012 | Giezendanner-Thoben | F02M 63/06 239/102.1 |
| 2015/0227807 | A1 | 8/2015 | Li | |
| 2016/0207052 | A1 | 7/2016 | Vijay | |

FOREIGN PATENT DOCUMENTS

| | | |
|---|---|---|
| CN | 101780999 | 7/2010 |
| WO | 2011037546 | 3/2011 |

OTHER PUBLICATIONS

Vijay, M.M. "Pulsed Jets: Fundamentals and Applications", Proc. 5th Pacific Rim International Conference on Waterjet Technology, New Delhi, India, 1998.

Yutkin, L.A., "Electrohydraulic Effect", Moskva 1955, English Translation by Technical Documents Liaison Office, MCLTD, WP-AFB, Ohio, USA, No. MCL-1207/1-2, Oct. 1961.

Huff C.F. et al., "Investigation into the Effects of an Arc Discharge on a High Velocity Liquid Jet", Sandia Laboratory Report No. 77-1135C, USA, 1977.

Vijay et al., "Modeling of Flow Modulation following the electrical discharge in a Nozzle", Proceedings of the 10th American Waterjet Conference, Aug. 1999.

Yan et al., "Application of ultra-powerful pulsed Waterjet generated by electrodischarges", Proceedings of the 16th International Conference on Water Jetting, France, Oct. 2002.

Vijay et al., "Numerical analysis of pulsed jet formation by electric discharges in a nozzle", Proceedings of the 14th International Conference on Jetting Technology, 1998.

Vijay et al., "Electro-discharge technique for producing powerful pulsed waterjets: Potential and Problems", Proceedings of the 13th International Conference on Jetting Technology—Applications and Oppurtunities, Oct. 1996.

Vijay et al., "Generating powerful pulsed water jets with electric discharges: Fundamental Study", Proceedings of the 9th American Water Jet Conference, Aug. 1997.

Llewellyn-Jones, "The Mechanism of Electrode Erosion in Electrical Discharges", Platinum Metals Review, 1963, vol. 7(2), pp. 58-65.

VLN Advanced Technologies, Inc., Low Frequency Forced Pulsed Waterjet—Electrodischarge Technique [retrieved from the internet by the Examiner on Apr. 27, 2016] <URL:http://web.archive.org/web/20020405080940/http://www.win-tech.com/prod2.html.

Office action for U.S. Appl. No. 14/741,101 dated Sep. 26, 2017.

Office action for U.S. Appl. No. 14/741,101 dated Mar. 29, 2018.

* cited by examiner

ELECTRODISCHARGE APPARATUS

CROSS-REFERENCE TO RELATED APPLICATIONS

This application is a divisional of U.S. patent application Ser. No. 15/153,336 filed May 12, 2016, which is a continuation of U.S. patent application Ser. No. 14/741,101 filed Jun. 16, 2015, which claims priority from U.S. Provisional Patent Application 62/105,779 filed Jan. 21, 2015 and from U.S. Provisional Patent Application 62/150,356 filed Apr. 21, 2015.

TECHNICAL FIELD

The present invention relates generally to electric discharge in a liquid and, in particular, to plasma blasting techniques.

BACKGROUND

High-pressure water jet technology is one of the most advanced technologies in the world. Applications of high-pressure continuous water jets vary from mundane operations such as crude cleaning of edifices to highly sophisticated manufacturing of high-precision products. However, for many industrial applications, such as cleaning petrochemical reactor vessels and mining of hard rocks, the technology, at present, suffers from serious drawbacks. This is because the magnitudes of pressures and powers required by continuous water jets for such applications are prohibitively high (>200 MPa and 250 kW per jet). The notion of using water jet techniques (forced cavitating or pulsed water jets) for such applications is a relatively new one. For example, extensive work conducted by Vijay has shown that forced cavitating and pulsed water jets can be very effective for cutting metals, etc. (Vijay, M. M., "Pulsed Jets: Fundamentals and Applications, Proc 5$^{th}$ Pacific Rim International Conference on Waterjet Technology, New Delhi, India, 1998). Similarly, when hard rocks are preweakened, the cutting rates will be higher and the operating costs will be lower because of the reduced wear rates and breakdowns of the cutter tools.

In the context of this specification, a distinction is made between the natural and forced discontinuous jets. The forced water jet concepts are referred to as "novel water jet techniques" in this specification. For example, a stream of high-speed droplets or slugs formed due to break-up of a continuous jet emerging in air can be regarded as a natural pulsed jet. Although natural discontinuous jets are simple to produce, their usefulness is limited because it is not possible to control their intensity and shape of the pulses which are directly related to their performance. In the case of forced pulsed and cavitating waterjets, on the other hand, it is possible to generate well-formed slugs or cavitating bubbles, by modulating a continuous water jet by high-frequency ultrasonic power resulting in enhanced performance (U.S. Pat. No. 7,594,614 B2; U.S. Pat. No. 8,297,540 B1 and U.S. Pat. No. 8,550,873 B2). However, the high-frequency cavitating and pulsed waterjets are not effective in massive fragmentation of hard rocks or rock-like materials, including explosives, such as used in landmines. The purpose of the novel electrodischarge technique disclosed in this application is to generate very powerful low-frequency (of the order of one or more pulses per second) pulsed waterjet with a precursor shock wave and subsequently a vaporous-cavitating waterjet.

Theoretically, the hydrodynamic phenomena accompanying electric discharges in quiescent liquids at atmospheric pressure have been known for more than a century. An electric discharge in a liquid at atmospheric pressure is known to cause the formation of a strong shock wave and a plasma bubble that could attain a maximum diameter of 10 mm in about 1 μs. The pressure in the plasma bubble can reach 2000 MPa or more depending on the power (voltage and current) of discharge. The interest in the technique for a variety of applications stems from the fact that these shock waves and the bubbles are sources of high power and the processing of materials is clean and can be controlled precisely (a definite advantage compared to explosives). Yutkin, for example, conducted a number of laboratory tests and demonstrated its usefulness in a variety of applications, ranging from metal forming to fragmentation of rocks, without commercial exploitation (Yutkin, L. A. "Electrohydraulic Effect," Moskva 1955; English Translation by Technical Documents Liaison Office, MCLTD, WP-AFB, Ohio, USA, No. MCL-1207/1-2, October 1961). In at least one embodiment of the present invention, the electrodischarge technique is used to modulate a stream of water flowing through a nozzle, that is, a low-speed waterjet or, in a nozzle filled with quiescent water. According to Huff & McFall (Huff, C. F., and A. L. McFall, "Investigation into the Effects of an Arc Discharge on a High Velocity Liquid Jet," Sandia Laboratory Report No. 77-1135C, USA, 1977), the arc discharge modulates the stream or quiescent water by three mechanisms: (1) the formation of an initial shock wave, (2) pulsed jet produced by the rapidly expanding plasma bubble and (3) the plasma bubble itself which eventually reverts into a cavitation vapor bubble. As these three hydrodynamic phenomena accompanying the discharge occur at different times, it is possible by a careful design of the nozzle-electrode configurations, as disclosed in this specification, to generate the shock only, the interrupted jet (produced by the rapidly expanding plasma bubble) only or, the cavitating waterjet only or, all the three phenomena in tandem to inflict immense damage on a target material. The nozzles shown in FIG. 1 and FIG. 2, for example, are meant to produce only shock waves. Since the frequency of operation is usually low (≈1.0 Hz), in the interrupted mode, the technique basically functions as a water cannon.

Generating shock waves in water by electric discharge is disclosed in U.S. Pat. No. 3,364,708 (Padberg). A shock plasma earth drill is disclosed in U.S. Pat. No. 3,679,007 (O'Hare). Various plasma blasting techniques are disclosed in U.S. Pat. No. 5,106,164 (Kitzinger et al.), U.S. Pat. No. 5,482,357 (Wint et al.), U.S. Pat. No. 6,283,555 (Arai et al.), U.S. Pat. No. 6,455,808 (Chung et al.), U.S. Pat. No. 6,457,778 (Chung et al.), and U.S. Pat. No. 7,270,195 (MacGregor et al.). In the foregoing patents, a probe with electrodes (e.g. coaxial electrodes) is inserted into a borehole in the rock formation which is then filled with water or electrolyte.

Although the prior art provides a qualitative description of the phenomena accompanying the electrical discharge in quiescent water, there is scant information with respect to the discharge in a moving stream of water. Therefore, the inventor has conducted extensive semi-theoretical (computational fluid dynamic analysis) and experimental work on the electrodischarge technique for the conceptual nozzles shown in FIG. 1 and FIG. 2. FIG. 3, for example, shows the very high pressures generated by the impact of a shockwave on the target material (Vijay, et al., "Modeling of Flow Modulation following the electrical discharge in a Nozzle," Proceedings of the 10$^{th}$ American Waterjet Conference, August 1999). The flow rate through the nozzle was 13 usgal/min at a pressure of 5 kpsi in the vicinity of the electrodes. The orifice (nozzle) diameter was 0.085 in. The magnitude of the electrical energy dumped between the electrodes was 20 kJ and the shock impact was at 81.2:s after the discharge. FIG. 4 shows the effect of placing a reflector upstream of the electrodes (the tip of the central electrode (de) in FIG. 1 (shown clearly by #29 and #29*a* in FIG. 11). The target is placed at 5 in from the nozzle exit. It is seen that at a time (t) of about 30:s, the plasma expands sending a shockwave 51 towards the nozzle exit and a shockwave S2 towards the inlet. Shockwave S1 leaves the nozzle at approximately 50:s and forms a high-speed wave (W1) which accelerates the front F1 of the original steady jet to F2. The front F2 impacts on the target at 78.2:s producing a peak pressure of 2,600 MPa at 81.2:s as shown in FIG. 3. Shockwave S2, on the other hand, is reflected as shockwave S3. This shockwave on passing through the plasma emerges as shockwave S4 and ultimately causes another high-speed wave W2 in the jet impacting the target at 104:s, creating pressure peaks, of the order of 1,700 MPa. These semi-theoretical results show the advantage of using a reflector in the nozzle configuration.

As illustrated in FIG. 5A, further computational fluid dynamic analysis has indicated the occurrence of multiple peaks in the impact pressure. This is due to the fact that the discharge voltage, as illustrated in FIG. 5B, is a decaying sinusoidal wave (Yan, et al., "Application of ultra-powerful pulsed Waterjet generated by electrodischarges," Proceedings of the $16^{th}$ International Conference on Water Jetting, France, October 2002). Thus, by proper design of the discharge circuit, it is possible to generate multiple shockwaves to impact the target, enhancing the performance of the pulsed waterjet generated by the electrodischarge technique.

The phenomena accompanying the discharge depend on several operating variables and configurational parameters of the electrode-nozzle assembly. The operating variables are the pressure in the chamber, which could be of the order of 15 kpsi (could be any pressure although a range of 10-20 kpsi provides good results), flow (determined by the orifice diameter, $d_o$, of the orifice, typically of the order of 13 usgal/min although a flow of 10-15 usgal/min provides good results), or quiescent water (depends of the volume of the nozzle chamber, typically of the order of a litre), magnitude the voltage (V) of the capacitor (typically of the order of 20 kV, but could be as high as 100 kV), capacitance (C) of the capacitor, energy ($E_c$) stored in the capacitor ($E_c$=0.5 $CV^2$). Depending on the capacitance, the energy stored in the capacitor bank could be as high as 200 kJ. Although the energy of discharge can be varied either by varying the voltage or the capacitance, to keep the size of the system compact, it is better to vary the voltage and the duration of discharge (Θ), which will depend on the magnitudes of L-C-R (inductance, capacitance and resistance) of the discharge circuit.

As indicated in FIG. 1 and FIG. 2, the configurational parameters are: the shape (contour) of the nozzle chamber to focus and propagate the shockwaves towards the nozzle exit, the shape (conceptual designs are illustrated in FIG. 7 and FIG. 8), diameter ($d_\forall$), location (k) of the electrodes from the nozzle exit, the gap (ι) between the electrodes. For example, as shown conceptually in FIG. 7, the inner contour of the nozzle could be an exponential curve and, in order to obtain smooth flow of water, the outer profile of the electrode would also be exponential, providing generally parallel surfaces.

As further illustrated in FIG. 1 and FIG. 2 and also, in the conceptual configurations shown in FIG. 7 and FIG. 8, there are several different shapes, size and dispositions of the electrodes in the nozzle. These figures also show two possible configurations of the electrodes. Whereas the purpose of the short plasma channel (FIG. 1) is to generate cavitation bubbles in the stream, that of the long channel is to produce a high-speed pulsed water jet (Vijay and Makomaski, "Numerical analysis of pulsed jet formation by electric discharges in a nozzle," Proceedings of the $14^{th}$ International Conference on Jetting Technology, 1998). From the standpoint of performance, the most important geometric parameters are (as shown in FIG. 1 and FIG. 2) the magnitudes of D/do, the distance k, the distance (gap) between the electrodes ι, the inner profile of the nozzle and the shape and disposition of the electrodes. These geometric parameters also determine the operating parameters such as the pressure of the liquid, electrical energy and frequency, etc. As an example, test results are illustrated in the plot of FIG. 6. For the given set of operating parameters listed in the legend, the speed of the pulsed waterjet depends considerably on the gap (ι) between the electrodes. The data clearly show that it is possible to increase the speed of the jet by almost a factor of three by simply increasing the gap between the electrodes from 6 to 22 mm. This method affords a simple means to significantly increase the speed of water slug without increasing the input electrical energy. This is very important for many practical applications such as neutralization of landmines where a pulse having a very high speed (≈1000 m/s) is required.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

The present invention, as exemplified by the embodiments disclosed and illustrated in the specification and drawings, is a novel electrodischarge apparatus (or system) that is capable of creating a plasma bubble due to the ionization of water inside a nozzle. A powerful shockwave is generated as a result of the electrodischarge in water. The shockwave emerges from the nozzle to provide a large impact pressure on a target surface.

An inventive aspect of the present disclosure is an electrodischarge apparatus having a nozzle that includes a discharge chamber that has an inlet for receiving a liquid and an outlet. The apparatus has a first electrode extending into the discharge chamber and a second electrode proximate to the first electrode to define a gap between the first and second electrodes. The apparatus further includes a switch to cause an electrical discharge across the gap between the electrodes to create a plasma bubble which expands to form a shockwave that exits from the outlet.

BRIEF DESCRIPTION OF THE DRAWINGS

Further features and advantages of the present technology will become apparent from the following detailed description, taken in combination with the appended drawings, in which.

Since the electrodischarge technique is quite complex, the components and parts shown in the figures are not necessarily drawn to scale and many variations are possible depending on the magnitude of the electrical energy deposited in the nozzle, water parameters, that is, quiescent or flow from the pump and, and various types of applications.

DETAILED DESCRIPTION

In general, and by way of overview, the present invention provides an electrodischarge apparatus and method.

Figure 1:
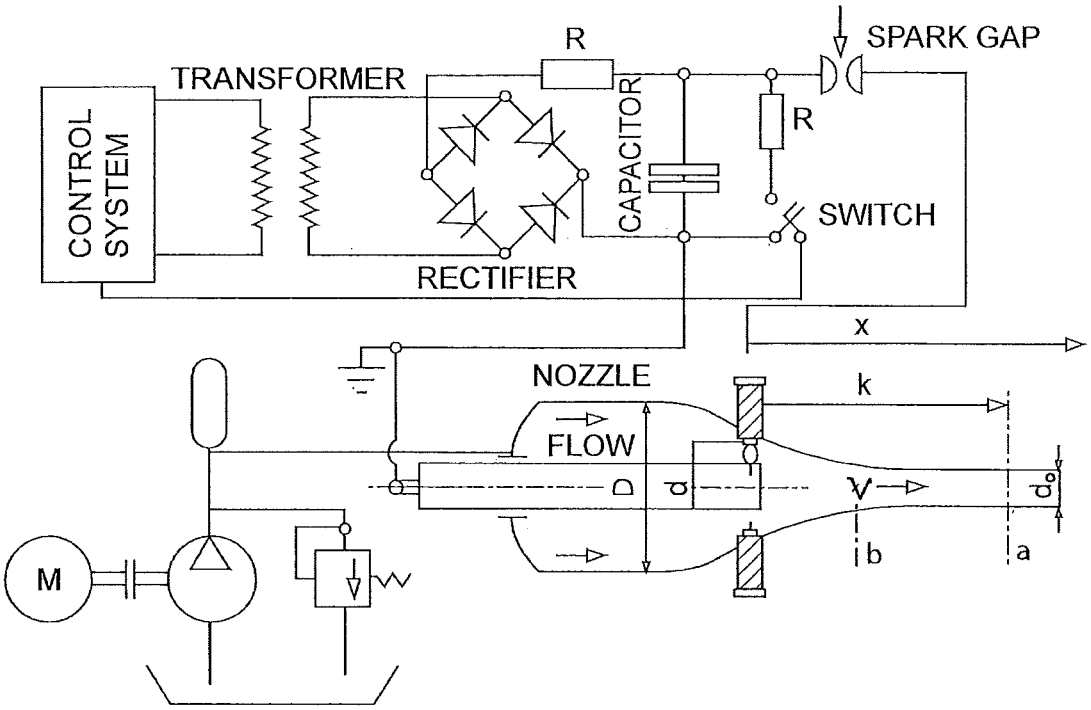
FIG. 1 is a schematic drawing of an electrodischarge apparatus showing the assembly of a capacitor bank with the spark gap switch, water pump and nozzle electrode assembly with a short gap between the electrodes.
Figure 3:
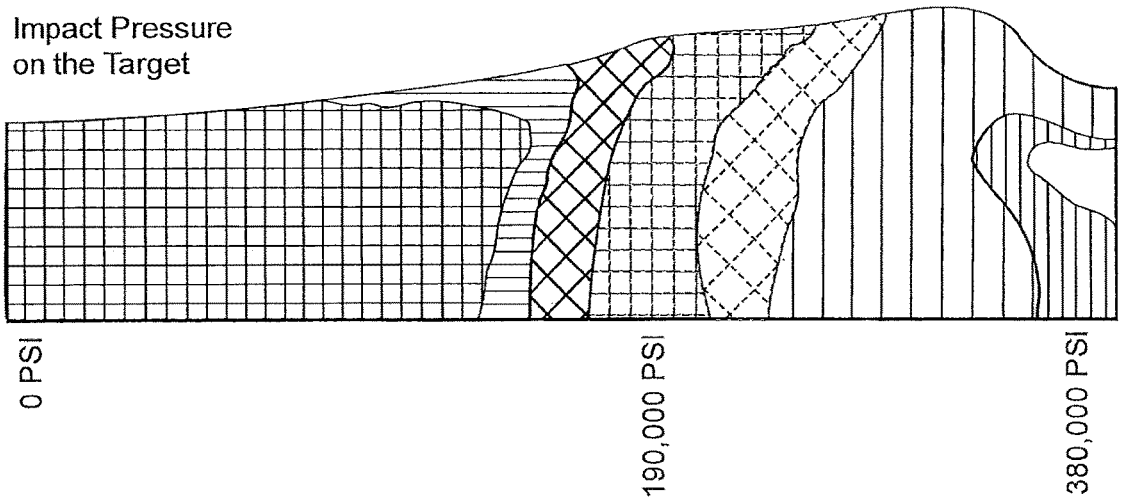
FIG. 3 is a graphical representation of pressure of the shockwave impacting the surface of a target obtained by numerical study (computational fluid dynamic analysis)

FIG. 1 is an assembly of a capacitor bank, a water pump to supply a stream of water at pressures of the order of 15 kpsi and the flow rate of the order of 20 usgal/min, a nozzle for producing a high-speed continuous waterjet and an electrode assembly for generating an arc at the rapid discharge of electrical energy stored in the capacitor bank by triggering the spark gap. In some embodiments, the invention also provides a technique for discharging the electrical energy in quiescent water filled in the nozzle. By incorporating a check valve, not shown in FIG. 1, it is possible to fill the nozzle after each electrical discharge. When the electrical energy is discharged rapidly between the electrodes, water in the vicinity of the electrodes breaks down to form a plasma which expands at a very high speed forming a shockwave as illustrated in FIG. 3. The shockwave moves ahead of the plasma bubble and escapes from the nozzle. The rapidly expanding plasma bubble momentarily interrupts the stream or perturbs the quiescent water forming a slug or pulse of high-speed water. As the plasma cools down, it simply becomes a bubble of water vapor, which is the cavitation bubble. A novel aspect of some embodiments of the invention stems from the fact that by careful design of the electrode nozzle assemblies one can produce each phenomenon (shockwave, interrupted pulsed waterjet or cavitation bubble) discretely or in a sequence one after the other. The objectives of the nozzles disclosed in this specification are either to produce individual effects or all the three effects following the discharge.

The characteristics of the phenomena accompanying the discharge depend on the electrical circuit parameters of the capacitor bank, configurational parameters and the shape of the nozzle chamber and the operating parameters. As an example of the circuit parameters, the energy, E, stored in the capacitor is a function of the capacitance, C, of the bank and the voltage, V, namely $E=\frac{1}{2}CV^2$ and for rapid discharge of the electrical energy in the nozzle, the inductance of the circuit should be as small as possible.

The fluid parameters are the pressure in the nozzle chamber, of the order of 15 kpsi if the pump is used for the flow which is of the order of 20 usgal/min, or atmospheric pressure if quiescent water is used, the capacity of the nozzle chamber being of the order of 0.25 usgal.

Figure 7:
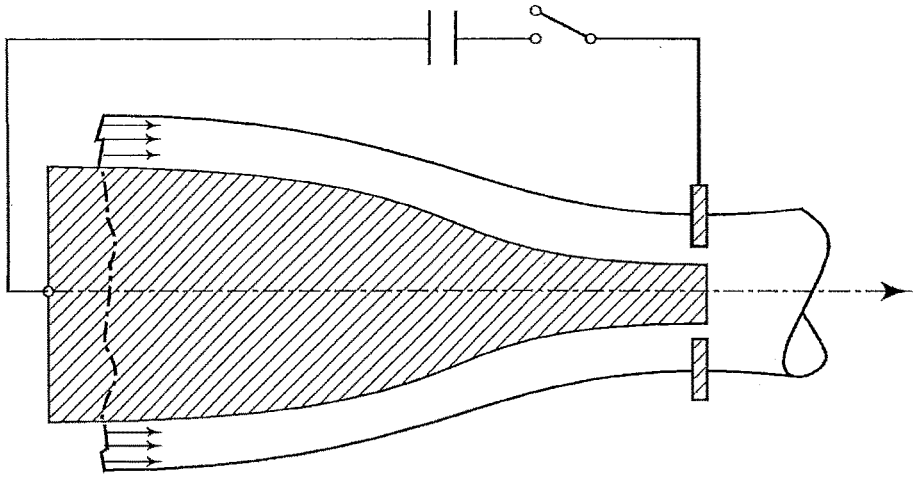
FIG. 7 is a schematic drawing showing the design of the nozzle-electrode configuration for producing a short plasma channel.

The configurational parameters of the nozzle electrode assembly are the shape and diameter of the central electrode, $d_V$, the chamber diameter, D, the distance between the electrodes, ι, length of the exit channel of the nozzle, k, and the orifice diameter, $d_o$, which is determined by the water flow rate. The shape of the inner surface of the nozzle could be any smooth curve, for example, exponential as shown in FIG. 7. The length, k, depends on the desired characteristics of the phenomena accompanying the discharge and is a function of $d_o$, for example, $d_o \leq k \leq 100\ d_o$.

Figure 2:
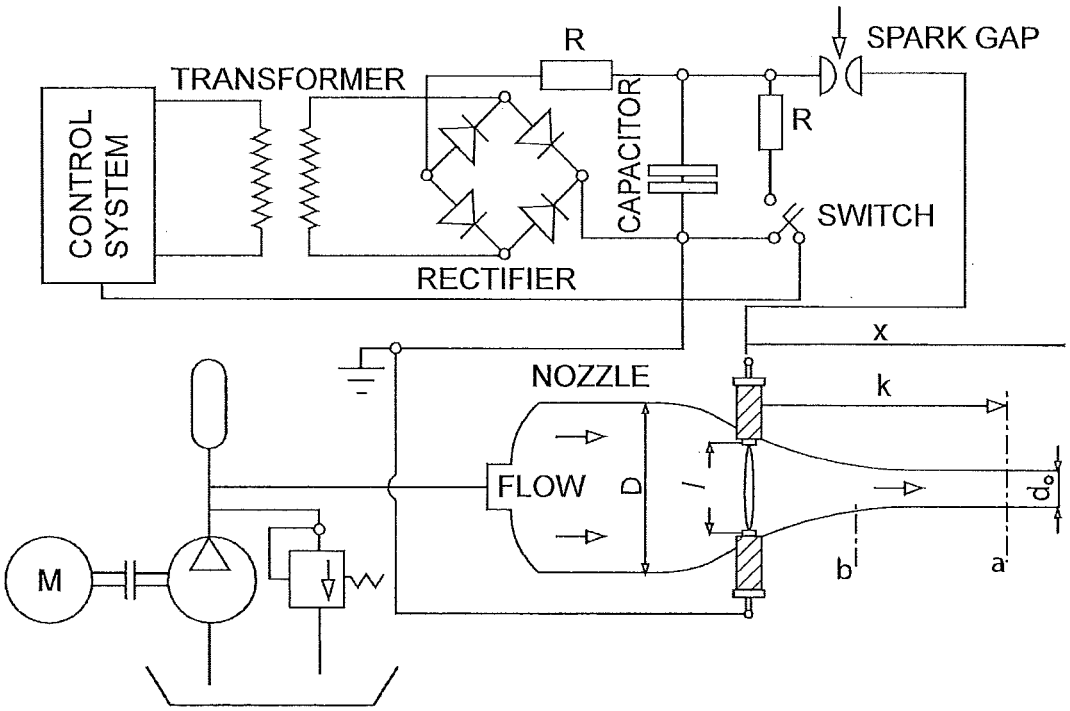
FIG. 2 depicts the same apparatus as shown in FIG. 1 except with a large gap between the electrodes.

FIG. 2 is the same as FIG. 1, showing a nozzle configuration with a larger gap width (ι) between the electrodes. A larger gap width (ι) between the electrodes generates more planar shock waves. A shorter gap width (ι) between the electrodes generates more spherical shock waves. The form of the shockwave can thus be varied by varying the gap width (ι) between the electrodes.

FIG. 3 is a typical appearance of the shock front after the rapid discharge of electrical energy between the electrodes, predicted by computational fluid dynamic (CFD) analysis.

Figure 4:
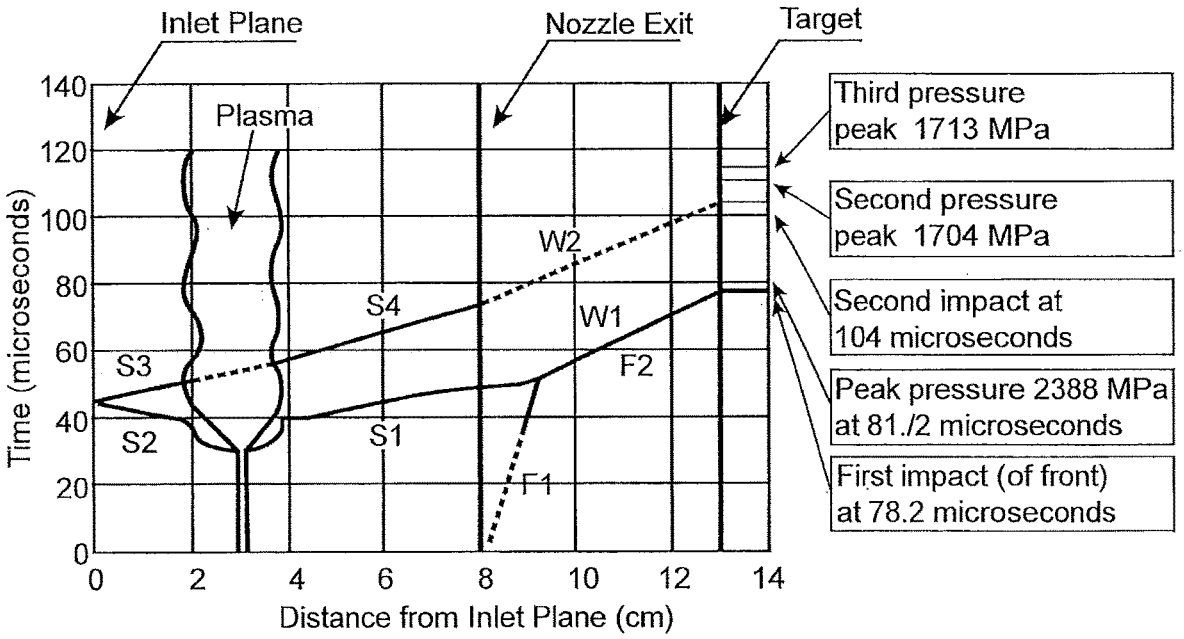
FIG. 4 is a plot showing the effect of a reflector on the shockwave.

FIG. 4 shows the benefit of placing a reflector upstream of the electrodes, once again predicted by the CFD analysis.

Figure 5A:
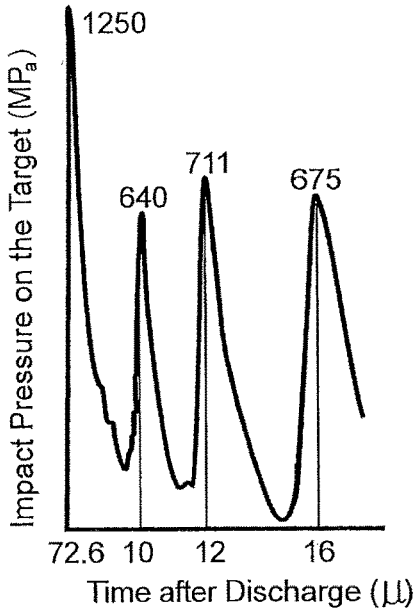
FIG. 5A is a plot of impact pressures as a function of time after the electrical discharge.
Figure 5B:
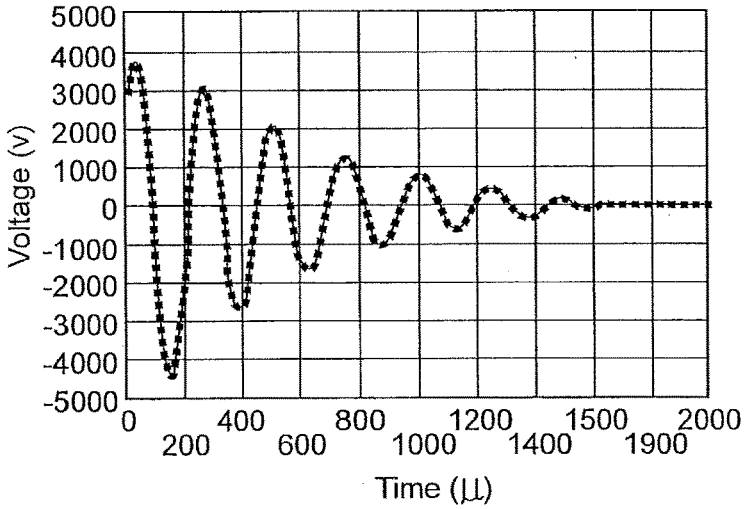
FIG. 5B is a plot showing the decaying voltage as a function of time after discharge.

FIG. 5A and FIG. 5B show the magnitudes of impact pressures on the target due to the varying (exponentially decaying sinusoidal) voltage after discharge, often called ringing frequency.

Figure 6:
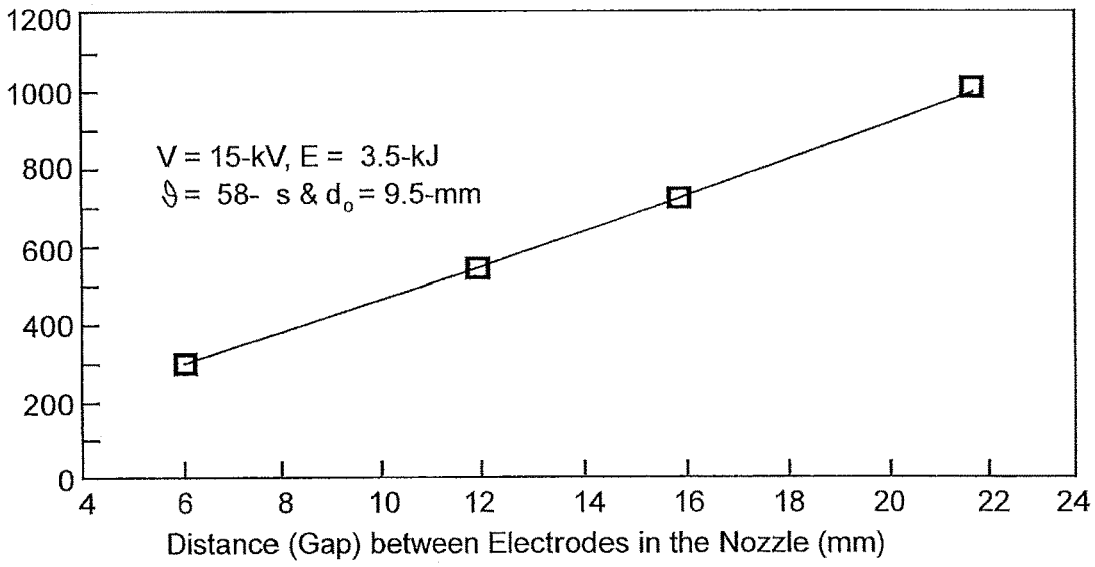
FIG. 6 is a plot showing the effect of the gap width on the magnitude of the speed of water pulse.

FIG. 6 shows, for the given set of voltage (V), electrical energy (E), duration of discharge (Θ) and the orifice diameter ($d_o$), the influence of the gap width (ι) on the speed of the pulse (slug) of water generated by the electrical discharge in the nozzle. It is remarkable that it is possible to increase the speed of the water pulse from approximately 300 m/s to approximately 1000 m/s, i.e. by a factor of more than three, simply by increasing the gap width from 6 mm to 22 mm. This observation is quite important from the standpoint of designing a robust and reliable nozzle for commercial applications. For instance, while a speed of 1000 m/s may be adequate for neutralizing a landmine, fragmenting a hard rock formation may require a speed of the order of 2000 m/s. As discussed in the Sections on electrodes (for example, FIG. 26), several types of nozzle-electrode assemblies may be required for withstanding the high shock loads after the discharge. The empirical data of FIG. 6 also show that the speed is linearly proportional to the gap.

FIG. 7 illustrates a conceptual design for discharging the electrical energy between the axisymmetric central electrode and the circumferential ring electrode. The tip of the central electrode also acts as a reflector for propelling the shock wave downstream towards the nozzle exit.

Figure 8:
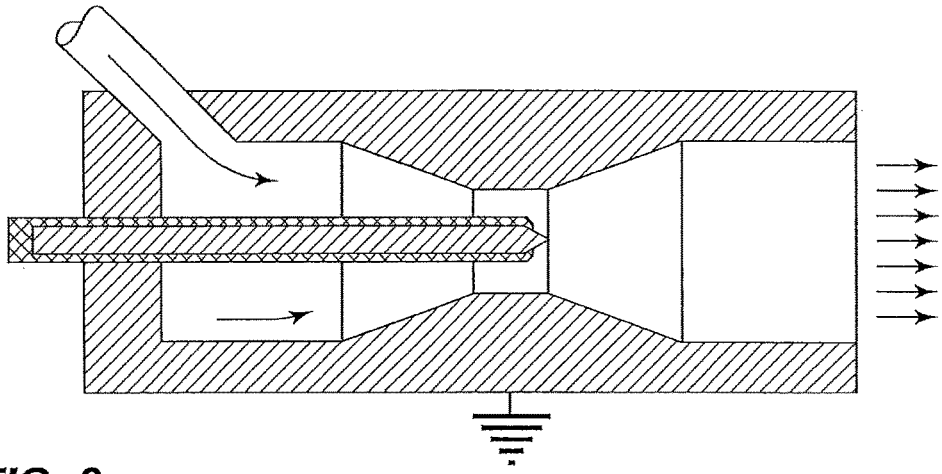
FIG. 8 is the same as FIG. 7 except the electrode is disposed in the axial direction for producing a long plasma channel.

FIG. 8 is another conceptual design having a converging section, a throat of constant cross-sectional area and a diverging section. The nozzle includes an insulated central electrode. In this configuration, as the nozzle is grounded, the discharge (spark and arc formation) occurs between the tip of the electrode and the inner surface of the nozzle. In the illustrated configuration, the tip of the central electrode is at the forward end of the constant cross-sectional area throat, i.e. at or near the plane where the throat ends and the diverging portion begins. Therefore, by moving the central electrode forward and backward from the throat of the nozzle, it is possible to vary the gap width (9. Yet another feature of this configuration is to capture the cavitation bubble formed by the discharge and focus it on the target. The bubble is confined in the annulus (annular stream of water) in the diverging section of the nozzle.

Figure 9:
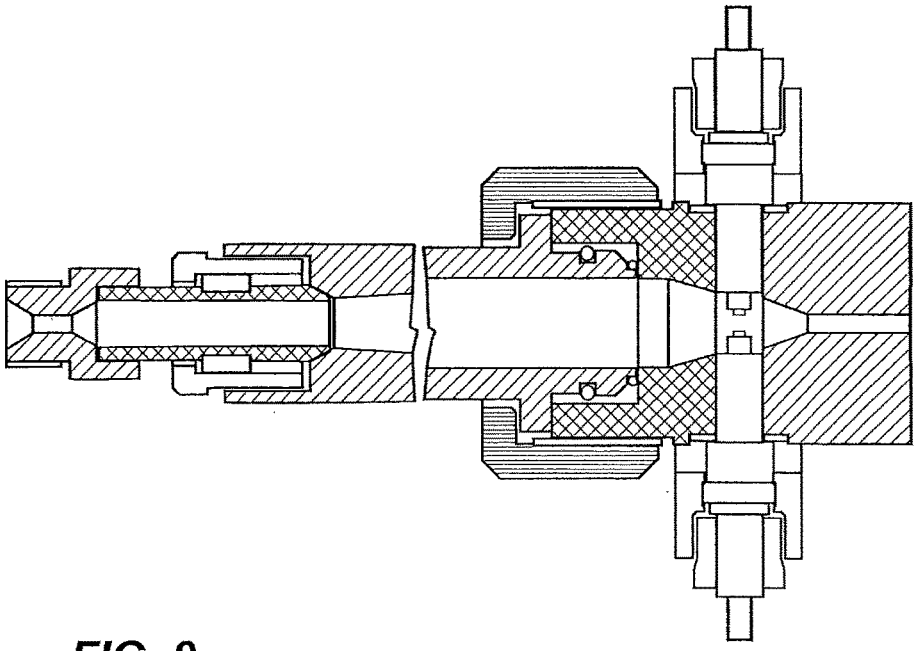
FIG. 9 is another embodiment of the nozzle-electrode configuration for producing a short plasma channel in a high-speed waterjet.

FIG. 9 shows a first rudimentary configuration investigated by the inventor to observe if the discharge would modulate a stream of high-pressure water to produce a pulsed waterjet (Vijay, et al., "Electro-discharge technique for producing powerful pulsed waterjets: Potential and Problems," Proceedings of the 13$^{th}$ International Conference on Jetting Technology—Applications and Opportunities, October 1996). The configuration has a long cylindrical channel 6 with a high-pressure fitting 1 at the upstream end for connecting a high-pressure hose and the nozzle insert 8 and the electrode assembly 10. The nuts 3 and 7 are respectively used to connect the high-pressure hose to the cylindrical channel and the nozzle-electrode assembly. Hard O-rings 4 and 5 and the gasket 9 seal the pressurized water flowing through the channel and at the interface between the nozzle and the electrode assembly. The maximum electrical energy discharged from the capacitor bank was of the order of 3.5 kJ, just sufficient to modulate the stream of water. Observations made and the lessons learned from this crude investigation form the basis for improvements disclosed herein. Just to cite one example, the strong electromagnetic radiation generated by the high transient current (of the order 50 kA, depending on the magnitude of the voltage) accompanying the high-voltage discharge destroyed most of the sensitive electronic devices in the vicinity of the test facility (Vijay et al., cited above), highlighting the necessity for shielding these devices.

As will become apparent from this specification, there are several embodiments capable of generating a shock wave, an interrupted jet caused by the expanding plasma bubble and the cavitation bubble which is simply the cooled plasma bubble. However, it is not possible to achieve all these phenomena accompanying the discharge in one nozzle configuration. Furthermore, a particular application dictates whether the electrodes are mounted in the transverse direction, as shown by way of example in FIG. 9, or mounted in the axial direction, as illustrated by way of example in FIG. 10.

Figure 10:
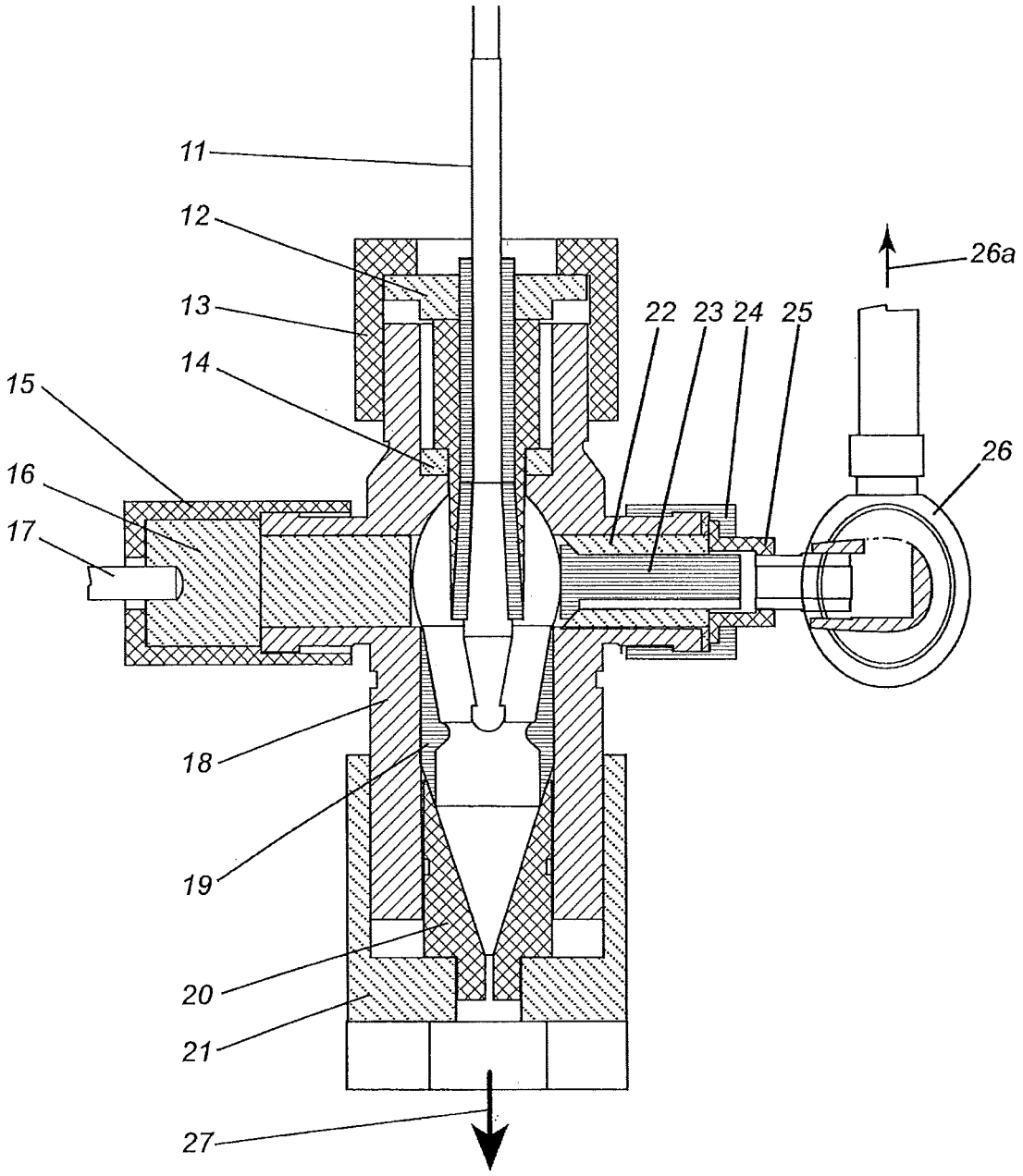
FIG. 10 is another embodiment of the nozzle-electrode configuration for producing long or short plasma channels.

In the embodiment shown in FIG. 10, the insulated electrode 11 is located in the axial direction in the nozzle body 18. The nozzle body 18 is composed of a lower housing 21 and a curved, hemi-spherical upper housing 13 (which may have another shape). The nozzle body 18 can be connected to a high-pressure pump through the inlet indicated by the 90° elbow 26 or filled with quiescent water using a check valve 23. Breakdown of water to form a plasma bubble after the discharge occurs due to the high-intensity electric field between the tip of the high-voltage central electrode 11 and the tip of grounded metallic ring 19. The electric field strength E is determined by V/ι, where V is the magnitude of the applied voltage and ι=gap width, that is, the distance between the tips of the electrodes. Depending upon the physical property of water, e.g. conductive, non-conductive, etc., the electric field strength required for breakdown is of the order of 3.4 kV/mm. By varying the position of the central electrode 11 and/or the grounded metallic ring 19 the required electric field for breakdown of water can be obtained. In the case of flowing water, generally depending upon the pressure, a wake forms downstream of the central electrode 11. The wake is a bubble composed partially of water vapor, which is actually vaporous cavitation. In this case, the strength of the electric field could be of the order of 1 kV/mm as the water vapor breaks down much more readily to form the plasma than water. In this embodiment, the apparatus also includes spacing rings 12 and 14 to vary the gap width (ι), the metal plug 16 to which a pressure sensor (not shown in the figure) could be attached to measure the pressure exerted by the plasma, a metallic rod 17 to connect the ground electrode to the cables leading to the capacitor, nozzle insert 20 having various diameter orifices (0.5 mm $d_o \leq 19$ mm), check valve body 22, nut 24 for fastening the water inlet component to the nozzle body 18, water inlet part 25, and the 90° elbow 26 for water inlet tube. The inlet tube is connected to a water pump by a hose 26*a* (which is not depicted in the figure). The tube can also be connected to a water bottle to provide quiescent water in the nozzle chamber. After each discharge, the chamber can be refilled by means of the check valve. Due to the small diameter orifices, the shock and the cavitation bubble most likely decay right inside the nozzle.

Figure 11:
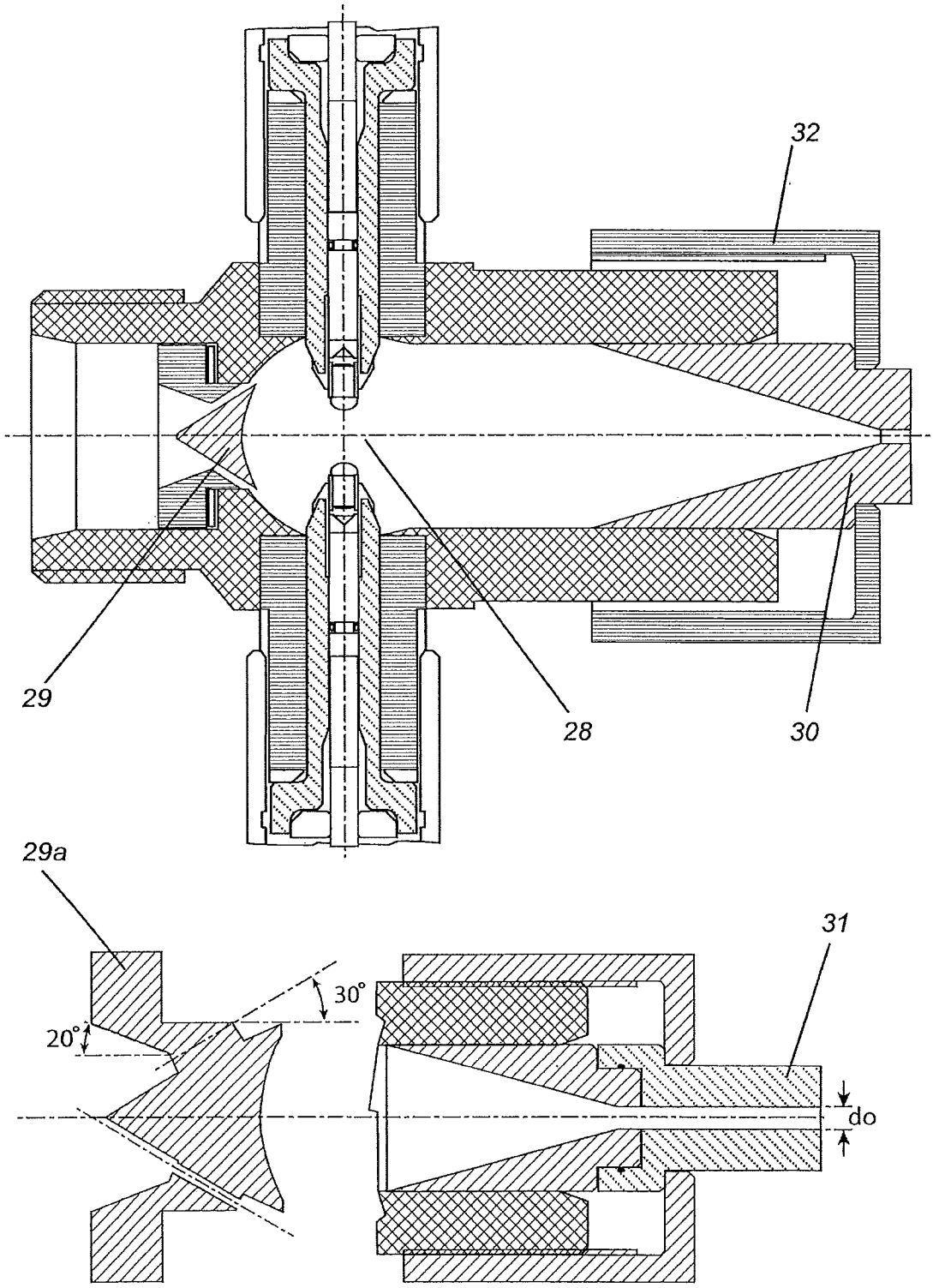
FIG. 11 is an embodiment showing the details of the electrode and a reflector to reflect the shockwave generated by the discharge.

FIG. 11 shows a nozzle configuration with the electrodes mounted in the transverse direction. By suitable design of the electrode assembly, discussed in a subsequent section, the gap width (ι) 28 can be varied from 1 mm to almost 30 mm. The configuration also shows the reflector 29 which also functions as a check valve momentarily stopping the flow of water 33 in the nozzle chamber until the next discharge. The details of one specific embodiment of the reflector are shown in 29*a*. The orifice diameters ($d_o$) in the nozzle insert 30 depend on the flow rates of water and can vary from 0.5 mm to 19 mm. The length of nozzle exit (L3) can be varied by attaching the extensions 31 with the nut 32. For short lengths, L3$\approx d_o$, and large orifice diameters ($\geq 6$ mm), the shockwave emerging from the electrode will have a spherical shape. As the lengths are increased, the wave will emerge as a plane wave. Furthermore, confinement of the plasma bubble in the cylindrical sections of the extensions generates a powerful pulse of water.

Figure 12:
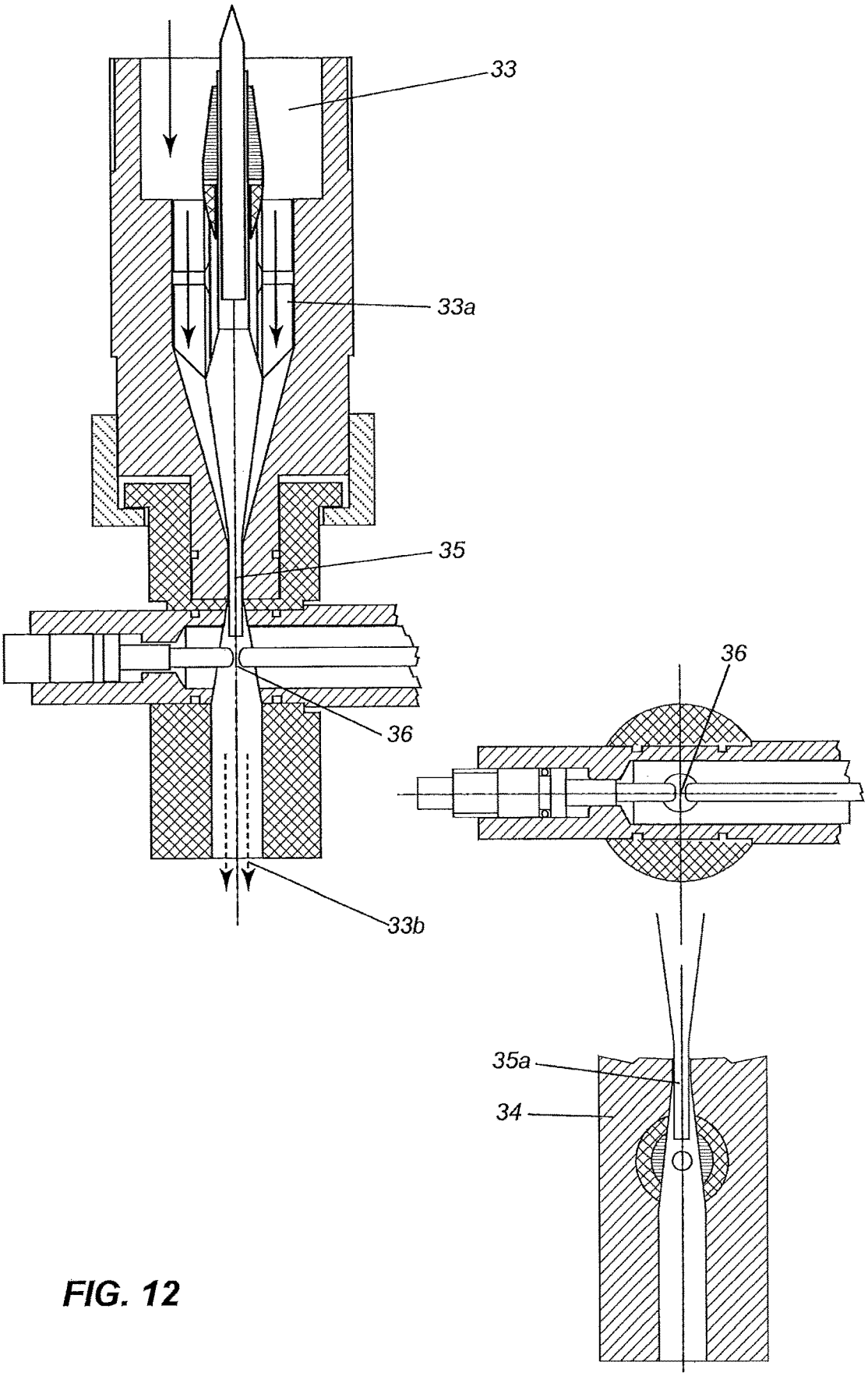
FIG. 12 is yet another embodiment showing transverse electrodes with the reflector.

FIG. 12 shows an embodiment to modulate a high-speed water stream, that is, a waterjet, to augment its cutting or fragmenting performance. Water from the pump enters through the inlet 33, flows through the annulus 35*a*, indicated by the dotted arrows 33*a*, between the centre body 35 (which may be a microtip of an ultrasonic transducer driven by an ultrasonic generator) and the nozzle insert 34. The centre body, which functions as a reflector, separates the flow and forms a wake (a low-pressure zone) in the gap 36 of the electrodes. In turbulent flow the wake is a stagnant zone composed of a mixture of dissolved gases, water vapor and quiescent water. With the rapid discharge of electrical energy, this mixture breaks down quite readily to form the plasma which travels in the diverging section downstream of the electrodes and in the cylindrical section 34 of the nozzle. The dimension of the annulus depends on the pressure and the flow rate required for a given application. As an example, if the required flow rate is of the order of 15 usgpm at a pressure of 15 kpsi, and for the size of 0.166 in of the cylindrical section of centre body 34, the dimension of the annulus is of the order of 0.006 in. As stated in section 10, since the gap width (ι) is of the order of 2 mm, the discharge produces spherical shock waves and plasma bubbles. In the long cylindrical section 34, the shock waves are transformed into plane waves before impacting the target. The plasma bubbles are confined within the annular flow of water, shown by the dotted arrows 33*b* to implode on the target and generate very high impact pressures enhancing the fragmentation ability of the continuous waterjet.

Figure 13:
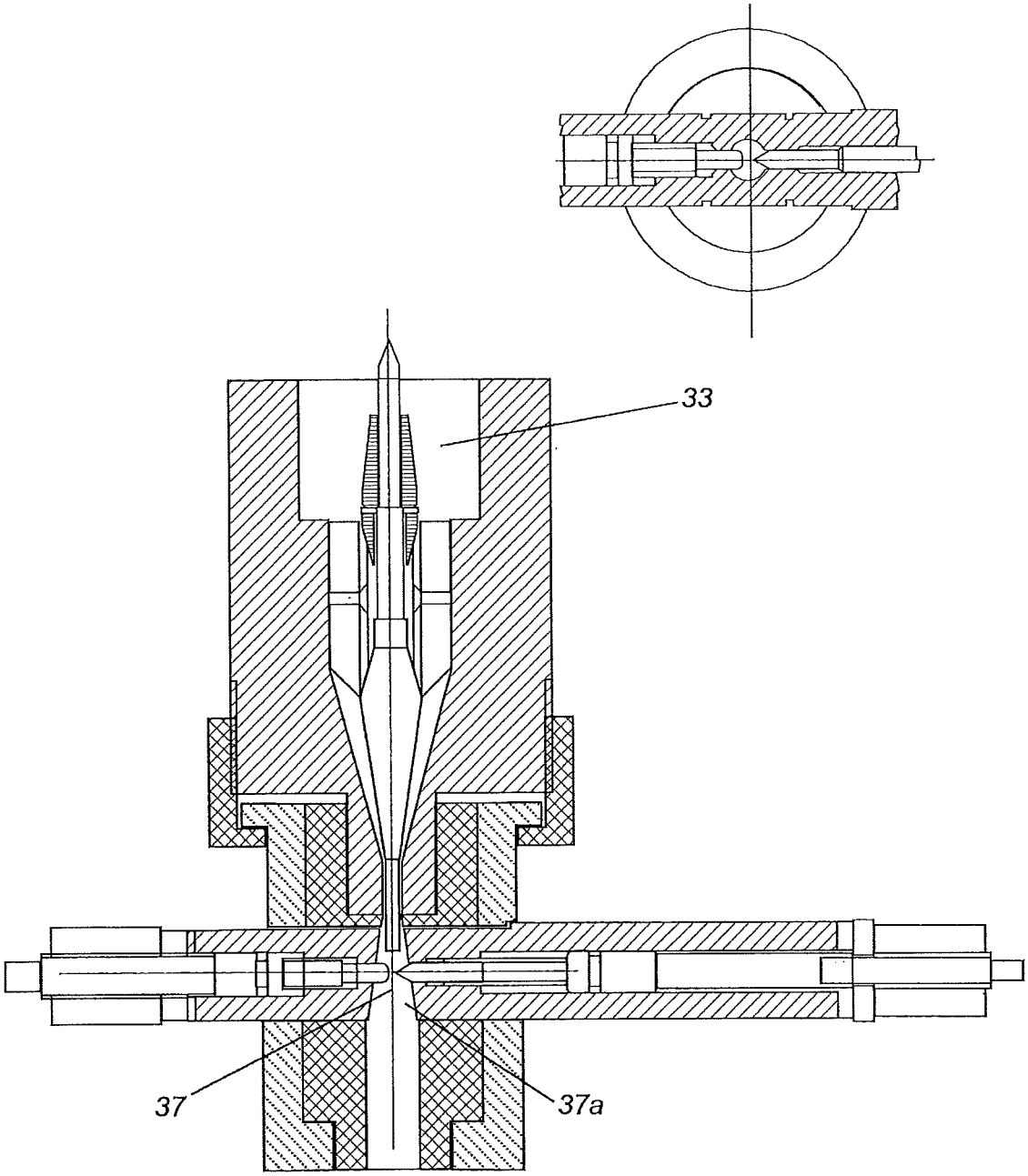
FIG. 13 is the same as FIG. 12, except the tips of the electrodes are planar and pointed to enhance the strength of the electric field.

FIG. 13 shows another embodiment which is similar to the one illustrated in FIG. 12, except that the tip of the grounded electrode is a plane 37 and the tip of the high-voltage electrode 37*a* is pointed like a needle. This configuration of the electrodes focuses the electric field strength for breaking down the water and intensifying the strength of the shock wave and the plasma bubble.

Figure 14:
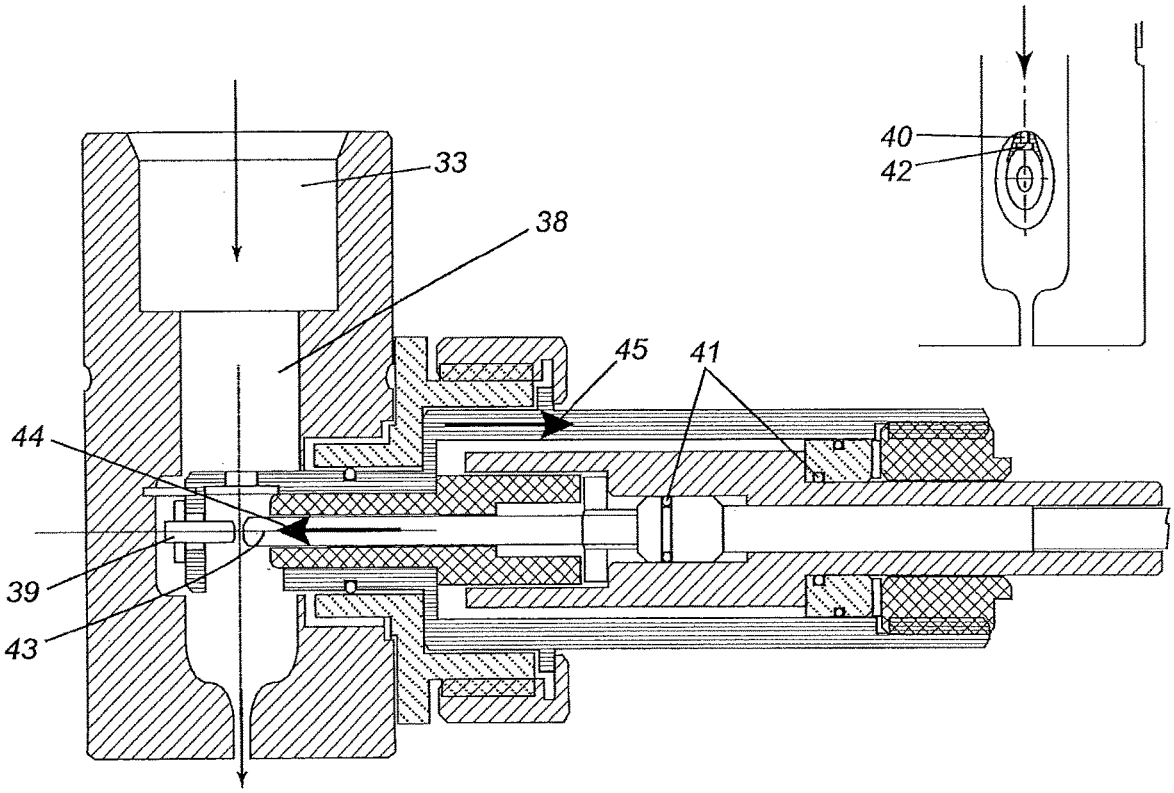
FIG. 14 is an embodiment showing how the ground and high-voltage electrodes are assembled as a single unit for sliding into and out of the nozzle.

FIG. 14 is another embodiment for modulating a high-speed waterjet with the electrodischarge technique. The nozzle body is composed of a large inlet section 38 to maintain a fairly low speed of water delivered by the pump 33, equivalent to quiescent water. The ground electrode 39 and the high-voltage electrode 43 are assembled as one unit (a detachable electrode assembly) so that it can be easily slid into and out of the nozzle body. In addition to the advantage of easy alignment, the current induced by the rapid discharge indicated by the dotted arrow 44 and flowing through the reflector 40 mounted on the ground electrode indicated by the dotted arrow 45 generates a high-intensity electromagnetic force which will provide additional force to increase the speed of the plasma bubble moving towards the nozzle exit. As the electrode assembly can be slid in and out of the nozzle body, the condition of the tips of the electrodes can be readily examined without disconnecting the electrical cables connected to the capacitor bank 1 (FIG. 1). The easily replaceable reflector 40 enhances the strength of the shockwaves as described in FIG. 4. The discharge zone 42 can be easily controlled by varying the position of the ground electrode 39.

Figure 15:
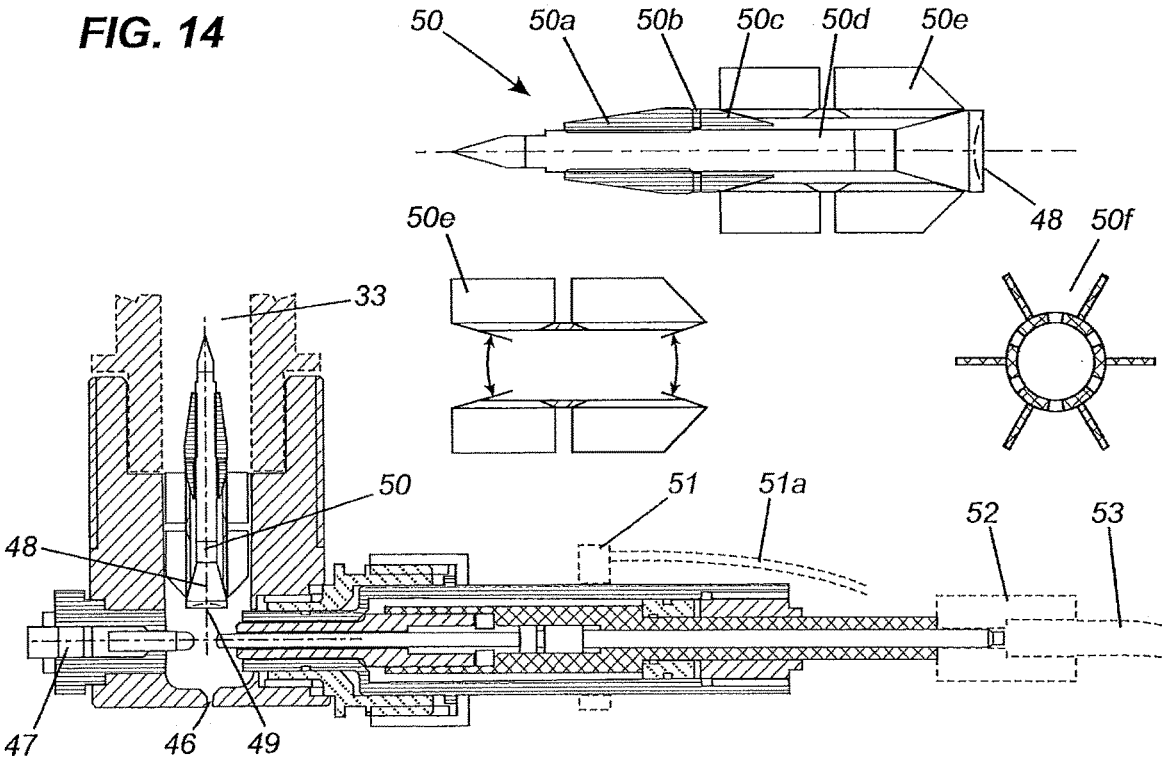
FIG. 15 is an embodiment in which the position of the reflector with respect to the electrodes can be varied.

FIG. 15 is an embodiment similar to the one shown in FIG. 12 except that the space surrounding the electrodes 49 can be varied to reduce the speed of water in the discharge zone, that is, the gap between the electrodes. It is also meant for fairly low pump pressure ($\leq 5$ kpsi) and moderate flow of water ($\leq 10$ usgal/min). In the embodiment depicted in this figure, the apparatus generates pulses of water by the imploding plasma bubble slightly upstream ($\approx 2\ d_o$) of the nozzle exit 46. In the illustrated embodiment, the apparatus includes a large water inlet 33 and a centre body 50 which also functions as a reflector 48. In addition to functioning as a reflector, it also incorporates a flow straightener 50*e* with vanes 50*f* to smoothen the flow, that is, to reduce the level of turbulence in the flow. In all the embodiments disclosed herein, it is important to reduce the level of turbulence in order to eliminate undesirable sparking (formation of an electric arc), also called tracking from the high-voltage electrode to another part of the nozzle other than the ground electrode. The straightener is mounted on a threaded mandrel 50*d*, fabricated from type-303 stainless steel or similar material. The mandrel 50*d* is held in place by the conical nut 50*a* fabricated from high-strength bronze or similar material and the cone 50*c* with a flat washer 50*b* to absorb the load induced by the shocks. The tip of the mandrel 48 has a shape of a concave hemisphere although in variants it could be parabolic or another suitable shape, to focus and propel the shocks towards the nozzle exit 46. The discharge zone downstream of the reflector 49 can be controlled by varying the position of the ground electrode tip 47. The bus bar 51 fabricated from brass or similar material connects the ground cables 51*a* to the capacitor bank and the connector 52 also made of brass or copper or similar material connects the high-voltage cables 53 to the capacitor bank. The number of shielded cables used (which may be $\geq 10$) depends on the transient discharge current generated by the energy discharged from the capacitor bank.

Figure 16:
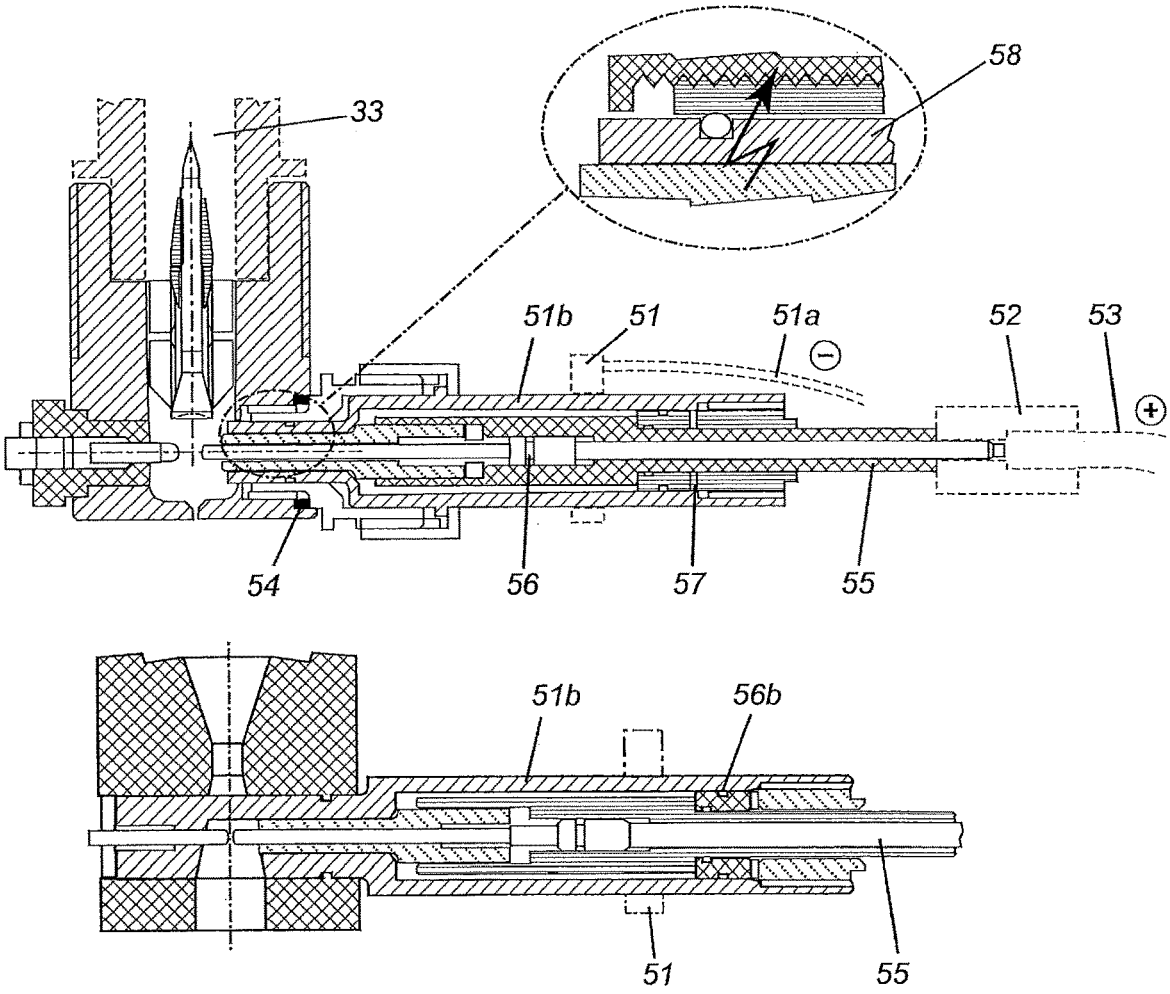
FIG. 16 is yet another embodiment as FIG. 15 showing the possibility of tracking (unwanted sparking) indicated in the inset.

FIG. 16 is the same embodiment as illustrated in FIG. 15 to highlight the precautions to be taken with high voltages (for example, voltages≥5 kV). The two major issues to address for reliability of the electrodischarge technique are: (1) sealing arrangements in all the embodiments and (2) prevention of undesirable sparks, often called tracking, which could destroy the insulating materials used to separate the ground electrode assembly 51 from the high-voltage electrode 55 (described in the Sections on Electrodes) and other materials. All of the illustrated embodiments of this invention require sealing, e.g. special O-rings 54, 56, 56*a* (4, 5 in FIG. 9), gaskets 57 (9 in FIG. 9) and washers or any other fluid-tight sealing means to seal against high transient pressures generated by the shocks and the high transient temperatures generated by the plasma bubble. High strength seals (≈90 durometer), such as Viton or similar O-rings may be used in these embodiments.

For efficient performance, the breakdown of water to form a plasma bubble must happen in the gap between the electrodes. However, the state of the flow (e.g. turbulent flow) and other factors may cause the discharge to take place at other locations, for example from the tip of the high voltage electrode to the inside surface of the nozzle chamber, which will eventually destroy the smooth surface of the nozzle. As illustrated 58, tracking can also occur between the high-voltage electrode stem 55 and inner surface of the ground casing 51*b* leading to the failure of the insulating material. These problems are overcome with the embodiments described below.

Figure 17:
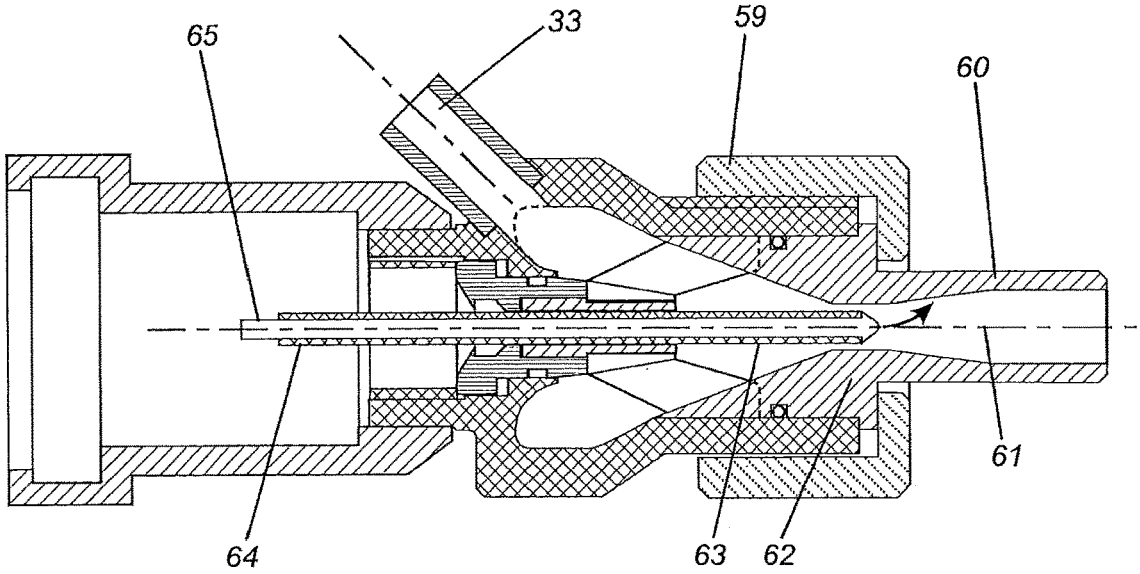
FIG. 17 is an embodiment based on the conceptual design illustrated in FIG. 8.

FIG. 17 shows an embodiment based on the conceptual design illustrated in FIG. 8. Water enters through the side port 33, fills the large volume of nozzle chamber 63 for reducing the speed of the flow and forms a wake downstream of the insulated 64 high-voltage electrode 65. By moving the electrode axially forward and backward, the discharge zone and length of the arc 61 formed by the discharge can be varied, giving rise to a range of plasma bubbles or plane or spherical shockwaves. The nozzle insert 62 is connected to the chamber 63 by the nut 59. The lengths of the diverging sections 60 can be varied from zero to any suitable length (≈10 in).

Figure 18:
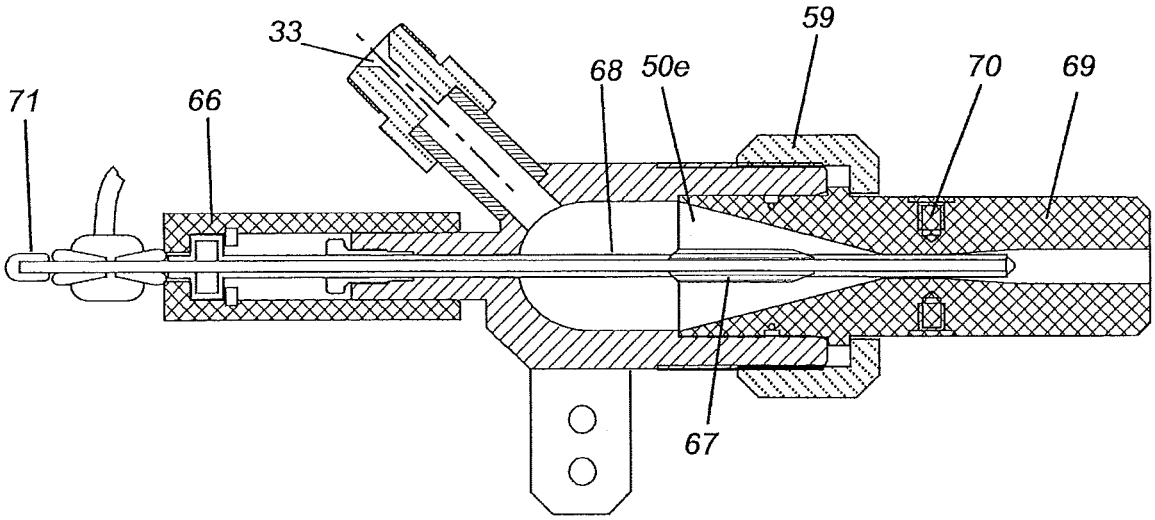
FIG. 18 is an embodiment for improving the alignment of the central electrode in the nozzle.

FIG. 18 shows another embodiment for modulating low water flows (≤2 usgpm/min) at very high pressures (≥20 kpsi). As in the embodiment of FIG. 17, high-pressure water enters through an inlet (side port 33) from the pump. Since low flows are involved, the annular clearance would be of the order of 0.002 in, forming a long wake downstream of the insulated electrode tip 70. The flow straightener 50*e* is mounted on a plastic stub 67 for adjusting its position upstream of the annulus. The axially located high-voltage electrode can be moved forward and backward to vary the gap width (ι) between the tip of the electrode and the inside surface of the grounded 70 nozzle attachment 69. The sleeve 66 fabricated from high-strength plastic holds the other end of the high-voltage electrode for easy movement in the nozzle attachment. The high-voltage cables are connected to the electrode through the adaptor 71. This embodiment produces pulses of water due to implosion of the plasma bubbles.

Figure 19:
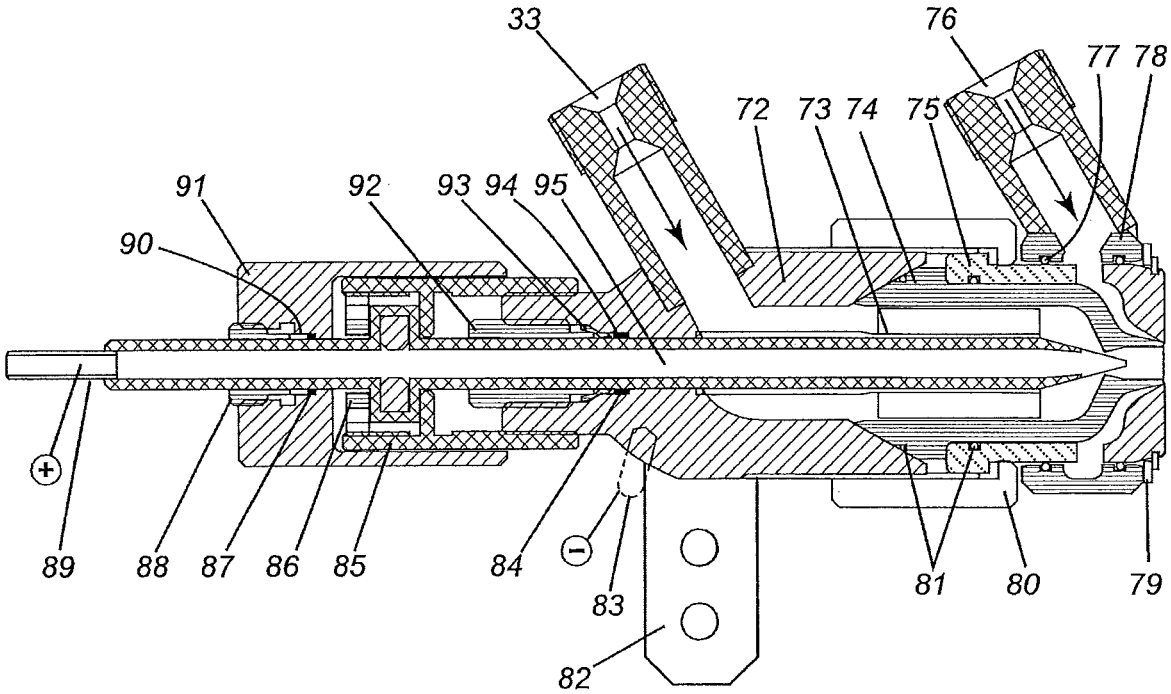
FIG. 19 is an embodiment of a highly complex nozzle configuration to confine the cavitation bubble produced by the electric discharge.

FIG. 19 shows a more complicated design in accordance with another embodiment to confine and focus the cavitation bubble which is, in fact, the plasma bubble when it cools down. In all the embodiments disclosed in this specification a cavitation bubble does indeed form. However, generally as soon as it arrives at the nozzle exit, it has a tendency to ventilate to the atmosphere without doing any useful work. The objective of the embodiment illustrated in FIG. 19 is to confine and focus the highly energetic cavitation bubble onto the target.

In the embodiment depicted in FIG. 19, the apparatus has a main body 72 to which the main nozzle 74 is connected with the nut 80 sealed with the O-rings 81. Water from the pump enters into the main body 72 through the port 33 and flows through the annulus between the electrode and the nozzle exit as indicated by arrows 33*a*. Electrical discharge occurs in this main flow. Water entering the sheathing nozzle 75 through the port 76 emerges as a sheath (annulus) of water around the main jet as indicated by dashed arrows 76*a*. The purpose of this secondary annular jet is to confine and transport the cavitation bubble towards the target to be processed. The port 76 is welded to the ring 78 and sealed with the O-rings 77.

Other components of the apparatus in accordance with this embodiment include an insulated central electrode 95, which is inserted into the guide tube 73 which also acts as a flow straightener (50*f*, FIG. 15) to align it with the nozzle exit, a gland 92, a back-up ring 93, bushing 94, cap for holding the high voltage electrode 91, and another back-up ring 90, another gland 88, locking ring 86 for the electrode, electrode nut 85, stainless steel rod 83 for grounding the main body 72, and the bracket 82 for securing the nozzle-electrode assembly to a gantry or a robotic manipulator, stem of the high-voltage electrode 89 for connection to the high-voltage cables and O-rings 84 and 87 to seal the electrode against leakage of water. Most of the components illustrated in this embodiment also apply to other embodiments.

Figure 20:
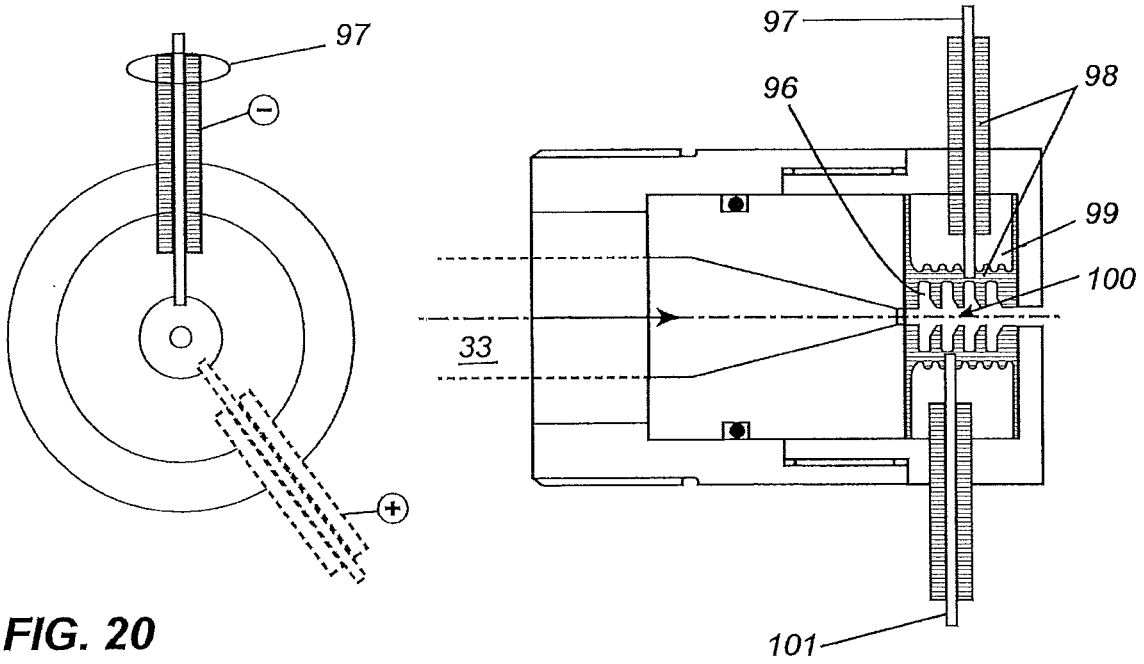
FIG. 20 is an embodiment with the electrode in the nozzle exit for generating sequential discharges.

FIG. 20 depicts an apparatus in accordance with another embodiment that is designed for one or several sequential discharges in the diverging exit section of the nozzle 100.

As the tips of the ring electrodes 96, placed circumferentially, are flush with the inner surface of the diverging section of the nozzle, the flow through the nozzle is quite smooth with no disturbances. The apparatus in accordance with this embodiment is meant for low flows (≈1 usgal/min) at low pressures (≈2 kpsi). The ring electrodes 96, the ground 97 and high voltage stems 101 are encased in silicon rubber 98 as insulating material. For additional safety the ring electrode assembly is embedded in a ceramic plug 99. A pair of electrodes can be fired once as in other embodiments. Or, they can be fired in sequence, over a delay of a few microseconds, to augment the intensity of the shock and plasma and propel them toward the target. This is possible because the line of spark, indicated by the dotted arrow, is in the same direction as the flow.

Figure 21:
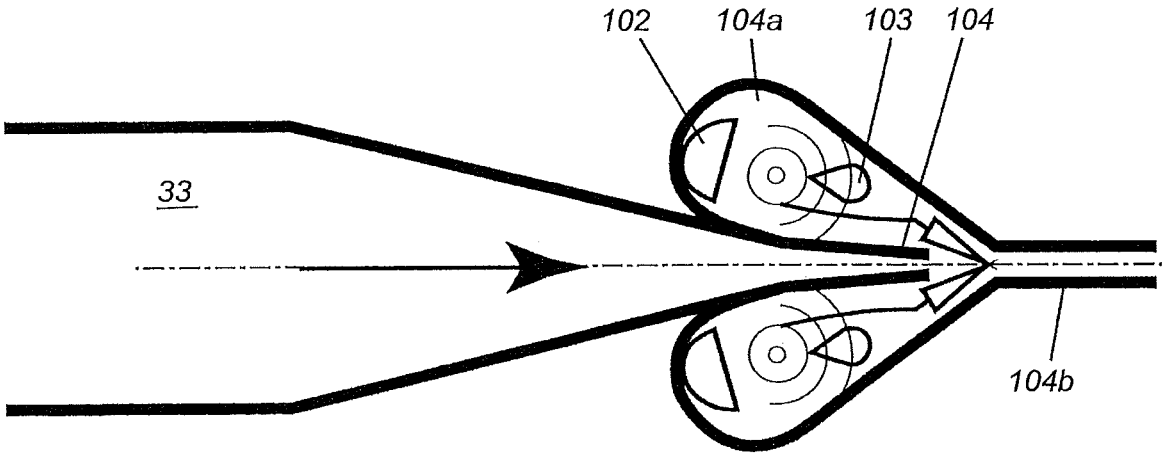
FIG. 21 is a conceptual design to enhance the power of the water pulse by the converging shockwaves.

FIG. 21 shows an apparatus according to yet another embodiment for intensifying the strength of shock waves formed in quiescent water in the nozzle. Theoretically, collision and convergence of two shock waves, indicated by the arrows, would increase the speed of the pulsed jet emerging from the nozzle. Ring-type ground electrodes 102 and ring-type high-voltage electrodes 103 are placed above and below the main nozzle 104. With a check valve, not shown in FIG. 21, the flow through inlet (or port) 33 from the pump or a water bottle, fills the nozzle chamber 104*a* and remains momentarily stagnant (quiescent). The expanding spherical shock waves following the plasma channel formation converge at the entry to the nozzle exit 104*b* augmenting the speed of the emerging pulsed waterjet.

Figure 22:
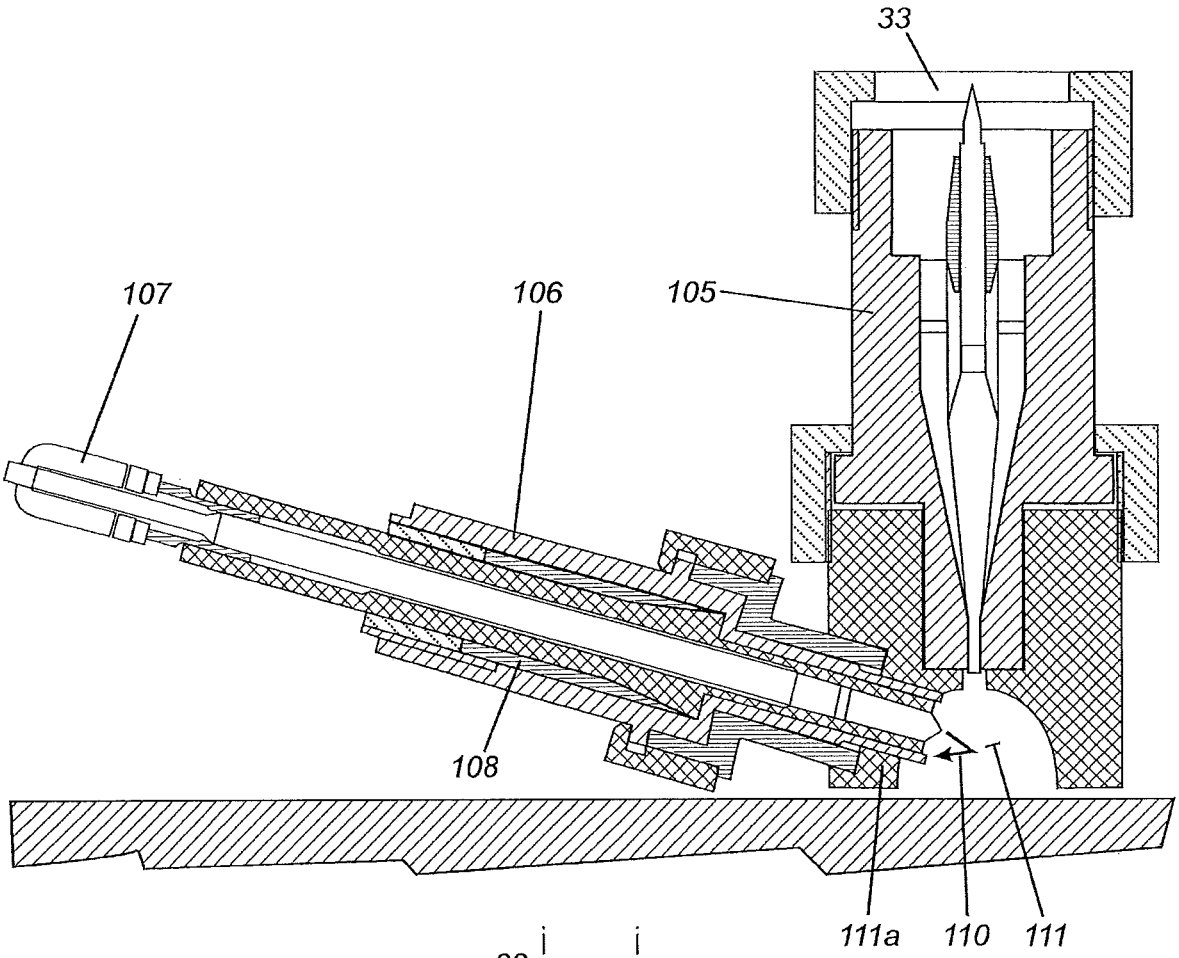
FIG. 22 is an embodiment that can be placed on the target to be processed, for example, fragmentation of concrete structures such as a nuclear biological shield.

In the embodiment depicted in FIG. 22, an apparatus is placed right on the surface 109 to be processed, for example, fragmenting the concrete biological shield of a nuclear power system. In this embodiment, the apparatus is basically the same as the embodiments illustrated in FIG. 12 and FIG. 13 with a hemispherical chamber 111 to focus the shock wave, plasma bubble and pulse of water to impact the surface. Water enters through the inlet (or port) 33 into the hemispherical chamber 111 and remains momentarily as quiescent water due to the abutment of the face 111*a* of the chamber against the surface 109. The reflector assembly is placed in the housing 105. The high-voltage electrode 107 and the ground shell 106 are assembled as one unit for easy insertion into the hemispherical chamber. The shock absorber 108 fabricated from high-strength elastomers is configured to absorb the high stresses generated by the shock waves. The discharge, as indicated by the arrow 110, takes place between the tip of the high-voltage electrode 107 and the tip of the ground shell 106.

Figure 23:
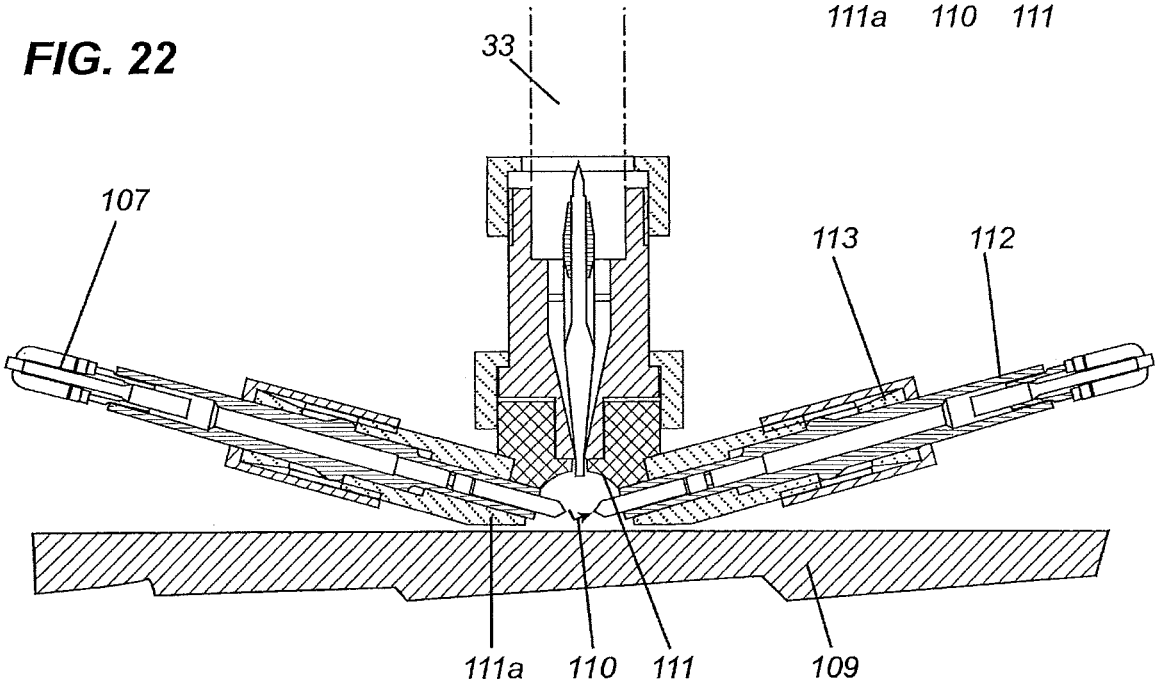
FIG. 23 is an embodiment having two electrodes to produce a short plasma channel close to the target.

FIG. 23 shows another embodiment similar to the embodiment depicted in FIG. 22, except it incorporates separate ground 112 and high voltage electrode 107, making it possible to vary the gap width (ι). As illustrated in FIG. 6, the speed of the pulsed jet can be increased by increasing ι, forming long plasma channel 110 which enhance the efficacy of the electrodischarge technique for inducing fractures (cracks) or fragmentation of very hard rocklike materials.

Figure 24:
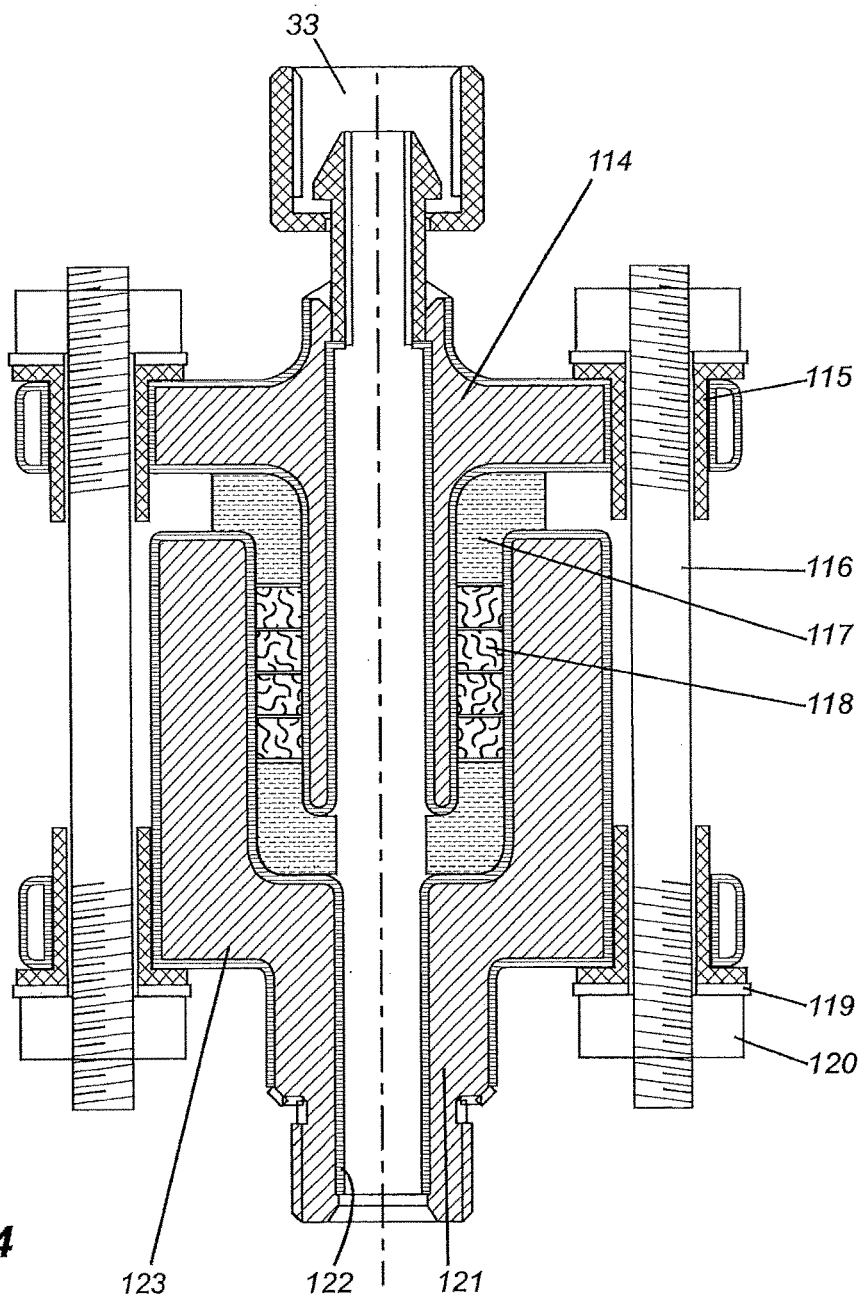
FIG. 24 is a drawing of the coupling to connect the nozzle to the pump.

FIG. 24 shows an embodiment for connecting nozzle electrode assemblies, disclosed in all the previous sections, to the water pump. As is known in the field of high-voltage engineering (T. Croft and W. I. Summers, "American Electricians Handbook," 14$^{th}$ Edition, McGraw Hill, 2002), extreme precautions need to be taken to ensure safety of the personnel and other equipment. In the case of electrodischarge technique, tracking (that is, undesirable sparking) needs to be eliminated by proper grounding of all the components, to the same ground, for example, a water pipe. The other major problem is to prevent the damage of electronic equipment caused by electromagnetic radiation caused by high transient discharge current, by proper shielding of all cables, etc.

In the case of a high-pressure water pump, the hose used generally consists of braided metal wire. Therefore, when the hose is connected to the grounded nozzle, the discharge current can also flow through the hose to the pump and may damage electrical components of the pump. The embodiment shown in FIG. 24 includes an insulated hose coupling to electrically isolate the pump from the nozzle assembly.

The coupling include a metal part 114 for connecting to the nozzle assembly 33 and the high-pressure fitting 121 fabricated from high-strength stainless steel. Both inner and outer surfaces of the metal part 114 and the fitting 121 are coated with epoxy or similar coating 122 as insulation. Sealing package 123 includes a soft packing 118 made from Teflon or similar material, held in place by high-strength plastic material such as glass-PEEK (Polyether ether ketone) 117. The parts are assembled and tightened by threaded studs 116 and nuts 120 with metallic washers 119 and a bushing 115 made from glass-PEEK or similar materials.

Figure 25:
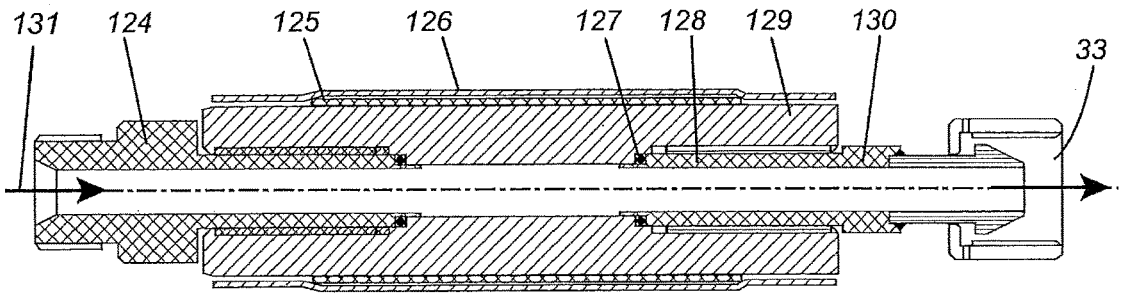
FIG. 25 is yet another embodiment to connect the nozzle to the pump.

FIG. 25 shows yet another coupling for connecting the pump to the nozzle assembly to eliminate grounding problems and which is suitable for low pressures (≈5 kpsi). A high-strength threaded 128 plastic insulator 129 is used to connect the high pressure fitting 124 for water flow 131 from the pump and the fitting 130 leading to the nozzle assembly. Water leakage is prevented by the O-rings 127. The plastic body was further reinforced from outside by a thermally shrunk metallic sleeve 125. The whole assembly was enclosed in a flexible plastic tubing 126 to provide additional electrical insulation.

It is quite clear from the descriptions given in all the previous sections that electrodischarge is a complex phenomenon requiring great deal of attention to design of all components to derive its benefits while preventing damage to personnel and other equipment in the vicinity of the electrodischarge apparatus. It is also clear that, depending on the application, it is possible to manufacture a variety of nozzle configurations (chambers) to optimize the performance of the electrodischarge technique. Each type of nozzle configuration requires a different type of high voltage and ground electrode assembly for efficient deposition of electrical energy in the chamber. This requires that the discharge should occur only between the tips of the electrodes and not anywhere else, that is, tracking (unwanted sparking, as illustrated by the bolded arrow 58 in FIG. 16) must be avoided. This is only possible by paying utmost attention to the design of electrode assemblies and how they are connected to the capacitor bank. In the following sections some of the configurations and the main features are disclosed.

Figure 26:
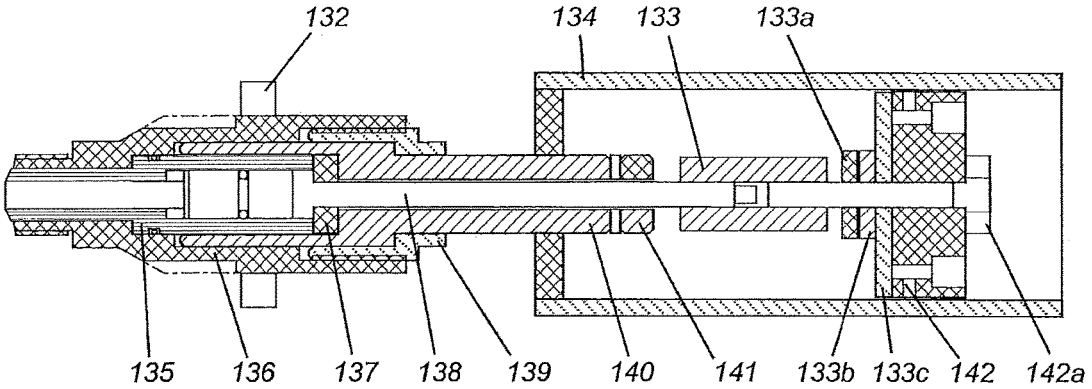
FIG. 26 is an embodiment of the high-voltage electrode and the adaptor to connect it to the cables from the capacitor bank.

FIG. 26 shows one embodiment of the electrode assembly and a component to connect it to the cables from the capacitor bank. This embodiment is meant for the nozzles of the type illustrated in FIG. 12 and FIG. 13 or similar types. The assembly shows the main body 136 fabricated from stainless steel or similar material connected to the ground bus bar 132. The central high-voltage electrode 138, fabricated from tungsten carbide or similar wear-resistant material, is insulated from the grounded main body by the coaxial tubes 135 and 140 fabricated from high dielectric strength plastic materials such as Ultem, PEEK or similar materials. The high-voltage electrode is secured by the main nut 139 made from stainless steel, and the lock nut 137 made from brass or bronze or similar soft metal and the nut 141. The high-voltage stem 138 is connected to the high-voltage bus bar assembly 142 of high-voltage cables by the coupling 133 made from brass, copper or similar highly conducting metals. The high-voltage bus bar is assembled by the stud 142*a*, the plastic nut 133*a*, plastic washer 133*b* and the plastic disc 133*c*. The high-voltage cables are secured by the set screws. For additional safety, the high-voltage bus bar assembly is enclosed in a plastic tube 134 made from acrylic or similar material.

Figure 27:
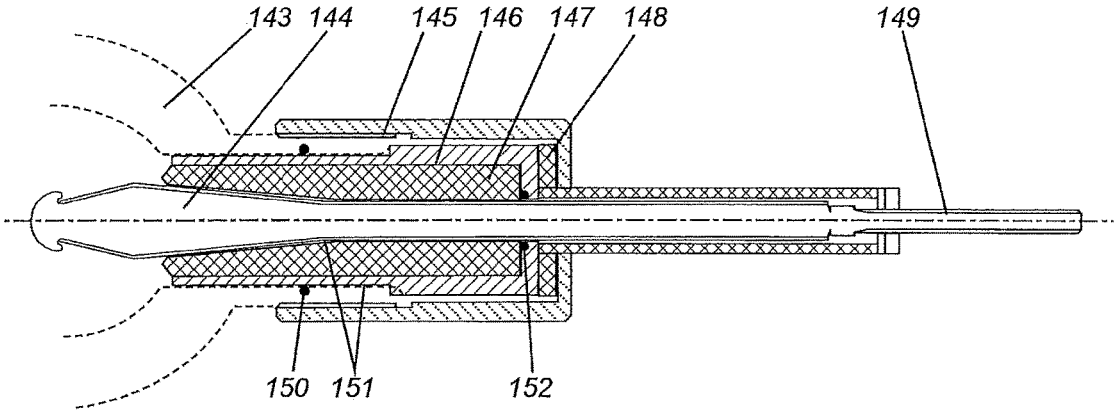
FIG. 27 is another embodiment of the electrode to withstand the high-strength shockwaves produced by the discharge.

FIG. 27 is another embodiment of an electrode assembly 143 for the nozzle configuration illustrated in FIG. 10 or similar types. The electrode configuration is meant for high static pressure of water (≈20 kpsi) and also high shock loading following the discharge. The front 144 of the high voltage stem 149 is shaped in the form of diverging and converging conical portions for self-sealing. As shown in this embodiment, the tip is a bulbous tip with the converging cone meeting a rear face of the tip to provide an angled annular lip. The entire rod is coated with epoxy 151 or any similar material, capable of withstanding high voltages up to a maximum of 50 kV and which is compatible with water. The high-voltage electrode 149 is inserted into two metallic sleeves 146 and 147 the outer surfaces of which are also coated with epoxy or similar high dielectric strength materials and are glued together with Loctite or similar adhesive. The electrode assembly is connected to the grounded nozzle body with the nut 145, making provision for changing the gap width (ι) by varying the thicknesses of the washers 148. Leakage of water is prevented by the O-rings 150 and 152.

Figure 28:
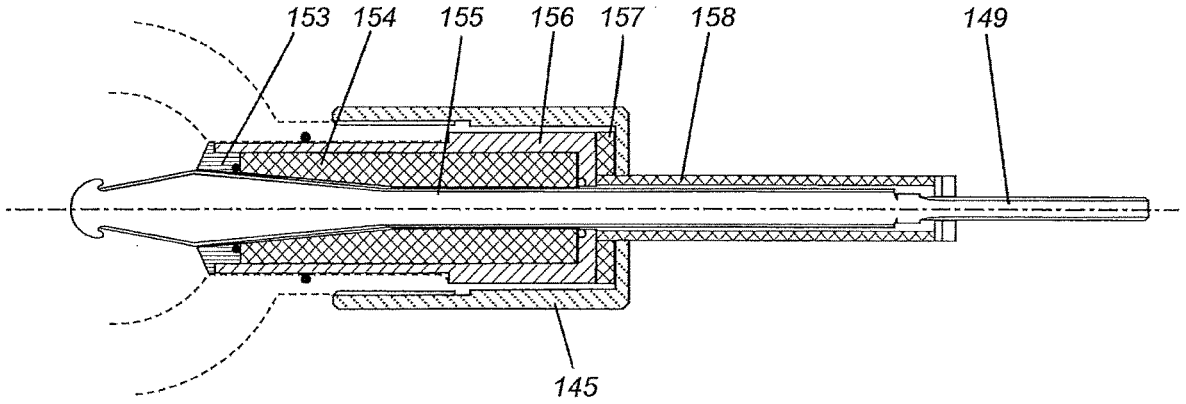
FIG. 28 is yet another embodiment of the high-voltage electrode.

FIG. 28 is yet another embodiment for use in the nozzle body shown in FIG. 10 or similar types. The electrode assembly has the same configuration as shown in FIG. 27 with slight modifications to eliminate tracking (undesirable sparking) between the high-voltage electrode 149 and the grounded nut 145. The coated high-voltage electrode 155 is surrounded by the inner sleeve 154 fabricated from high strength plastic PEEK or similar material, which is inserted in the metallic sleeve 156, the inside surface of which is coated with epoxy or similar materials. The electrode assembly is protected by the ring 153 fabricated from soft metal or elastomers. The gap width (ι) can be varied by the washers 157. Plastic tubing 158 surrounding the rear portion of the electrode 155 prevents any tracking from the electrode to the washer.

Figure 29:
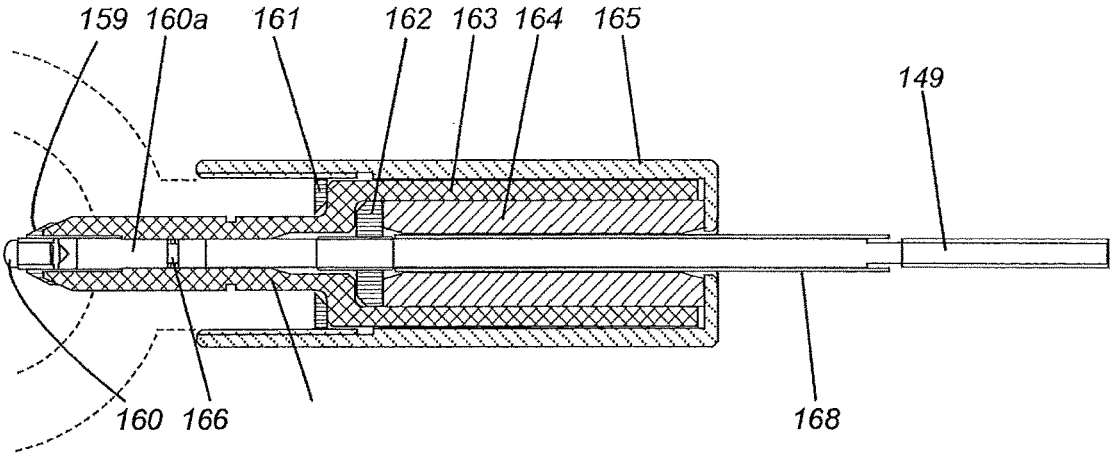
FIG. 29 is yet another embodiment of the electrode.

FIG. 29 shows an embodiment of the electrode assembly for the nozzle configuration illustrated in FIG. 12 or similar types. The high-voltage electrode 149 is insulated from the grounded nut 165 by two plastic sleeves 163 and 164 which may be made from Ultem, PEEK-glass or similar materials. As plastic materials are generally brittle, the sleeves are kept under compression by the nut 162 made from bronze or similar material and the metallic protector 159 made from stainless steel or similar material. The protector is glued or bonded to the sleeve 163 by a strong adhesive, such as Loctite or similar adhesive. The gap (ι) between the electrodes can be varied by using the spacing rings 161 made from Lexan or similar materials. Sealing is achieved by the hard Parker O-rings 166 and 167. The tip 160 made from tungsten copper or similar material is silver soldered to the front 160*a* of the high-voltage stem 149. For additional protection the high-voltage stem 149 is inserted into a tubing, e.g. a Tygon® tubing 168.

Figure 30:
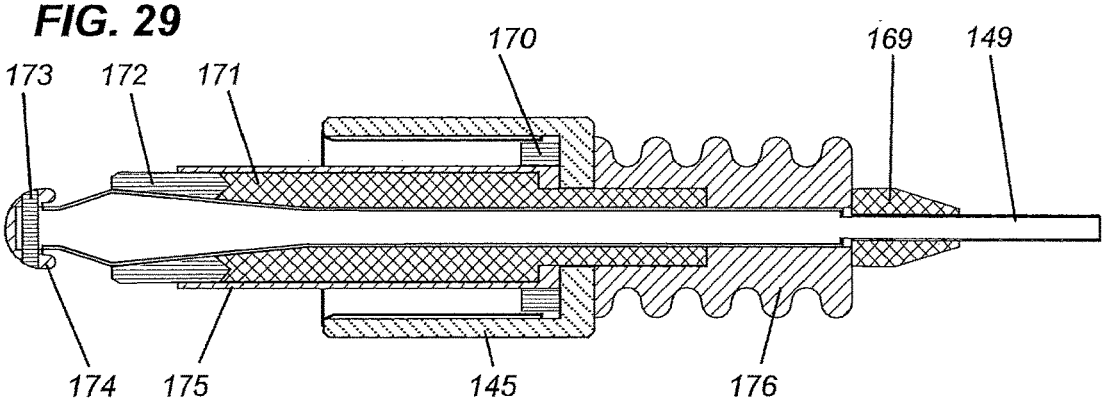
FIG. 30 is yet another embodiment of the electrode assembly.

FIG. 30 depicts yet another embodiment of an electrode assembly for use in the nozzle body shown in FIG. 10 or similar types. It is similar to the electrode assemblies depicted in FIG. 27 and FIG. 28 with some additional novel and safety features. The high-voltage electrode 149 includes the tip 174 which is held in place by a pin 173. When the tip 174 wears off due to ablation caused by the sparks, a new one can be easily inserted to continue the operations where repeated discharges are required. The sleeve surrounding the electrode includes a central insulator 171 made from PEEK or similar material and the front insulator 172 made from elastomers to absorb the shock loads caused by the discharge. The assembly of the electrode and the sleeves are glued to the coated outer metallic sleeve 175. The assembly is inserted into the nozzle housing 143 and tightened by the grounded nut 145. The gap width (ι) can be varied by the washers 170. In order to prevent tracking between the rear part of the nut 145 and the high-voltage cable connector 169 or the stem 149, an insulator 176, similar to the undulating or sinusoidal shape used in high-voltage transmission lines, is inserted as shown.

Figure 31:
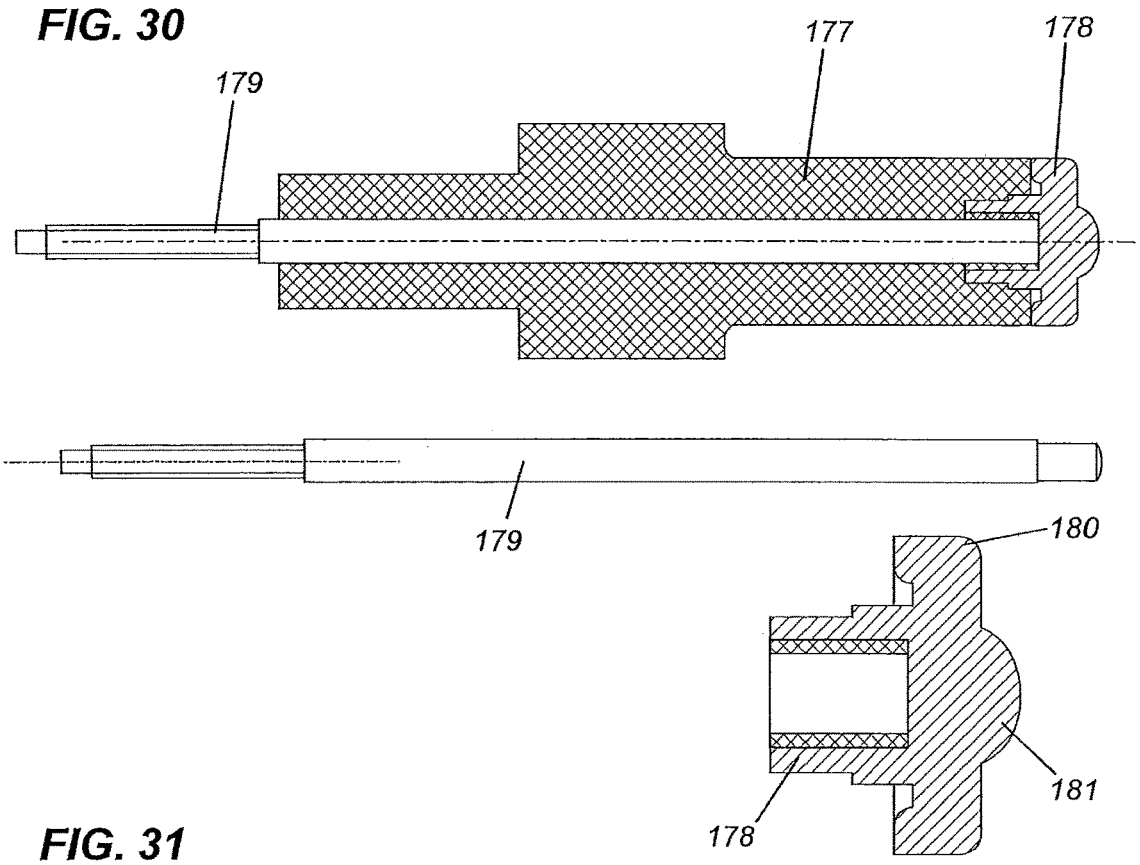
FIG. 31 is an embodiment showing a detailed drawing of the insulating material surrounding the high-voltage electrode.

FIG. 31 illustrates a high-voltage electrode assembly according to another embodiment that can be used for any nozzle configuration for moderate operating pressures (≈40 kpsi) and voltages up to 20 kV. The tip 178 is threaded to the high-voltage stem 179. In order to prevent tracking between the tip 181 and at any location on the inside surface of the nozzle body, the shoulder 180 is coated with a high-dielectric-strength plasma coating such as aluminum oxide or a similar material. The high-voltage stem 179, except the threaded part, is also coated with the plasma coating. The curved, hemispherical or any other shape part of the tip 181 can be coated with high ablation resistant metal, such as an alloy of tungsten carbide, chromium and cobalt or similar components, to prolong the life of the electrode. The stem itself can be fabricated from inexpensive metals such as brass or copper. As the tip wears off, a new tip can be easily connected to the threaded electrode stem reducing the downtime. The coated electrode stem is enclosed in a sleeve 177 fabricated from high-strength plastic or a metal coated on all sides with an insulating material same as the shoulder 180, using plasma or any other coating technique.

Figure 32A:
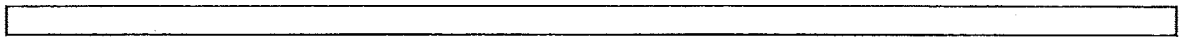
FIG. 32A is a drawing showing an aluminum disk prior to deformation.
Figure 32B:
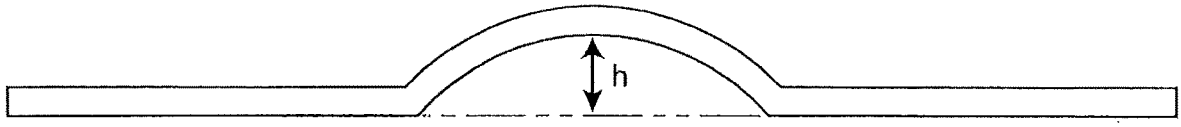
FIG. 32B is a drawing showing the intensity of a pulsed waterjet indicated by the deformation of aluminum disk.
Figure 32:
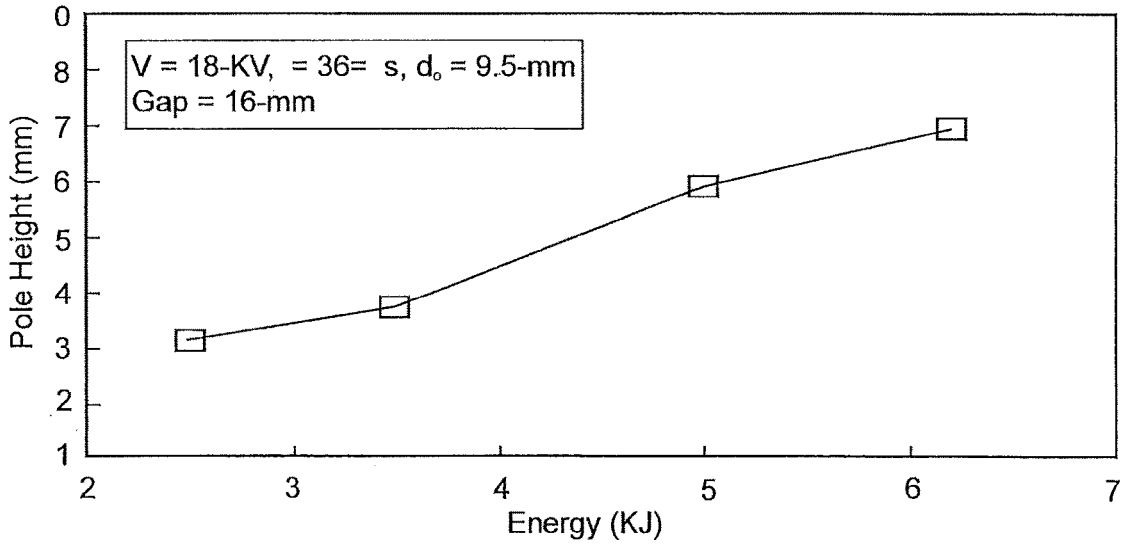
FIG. 32 is a plot showing the pole height of the deformed disk as a function of the discharge energy.

FIG. 32 illustrates the very preliminary results obtained with the electrodischarge technique by the inventor (Vijay, et al., Generating powerful pulsed water jets with electric discharges: Fundamental Study," Proceedings of the 9$^{th}$ American Water Jet Conference, August 1997). Aluminum discs were subjected to the pulsed waterjet emerging from a nozzle of the type illustrated in FIG. 11. FIG. 32A shows the aluminum disc prior to being subjected to the pulsed waterjet emerging from a nozzle of the type illustrated in FIG. 11. FIG. 32B is a drawing showing the intensity of a pulsed waterjet indicated by the deformation of aluminum disk. The height of the pole formed by the deformation caused by the impact of the pulsed jet is an indication of the efficacy of electrodischarge technique for industrial applications such as mining of minerals and humanitarian applications such as neutralizing landmines. The deformation is clearly a function of the electrical energy discharged between the electrodes at a gap width of 16 mm.

Figure 33:
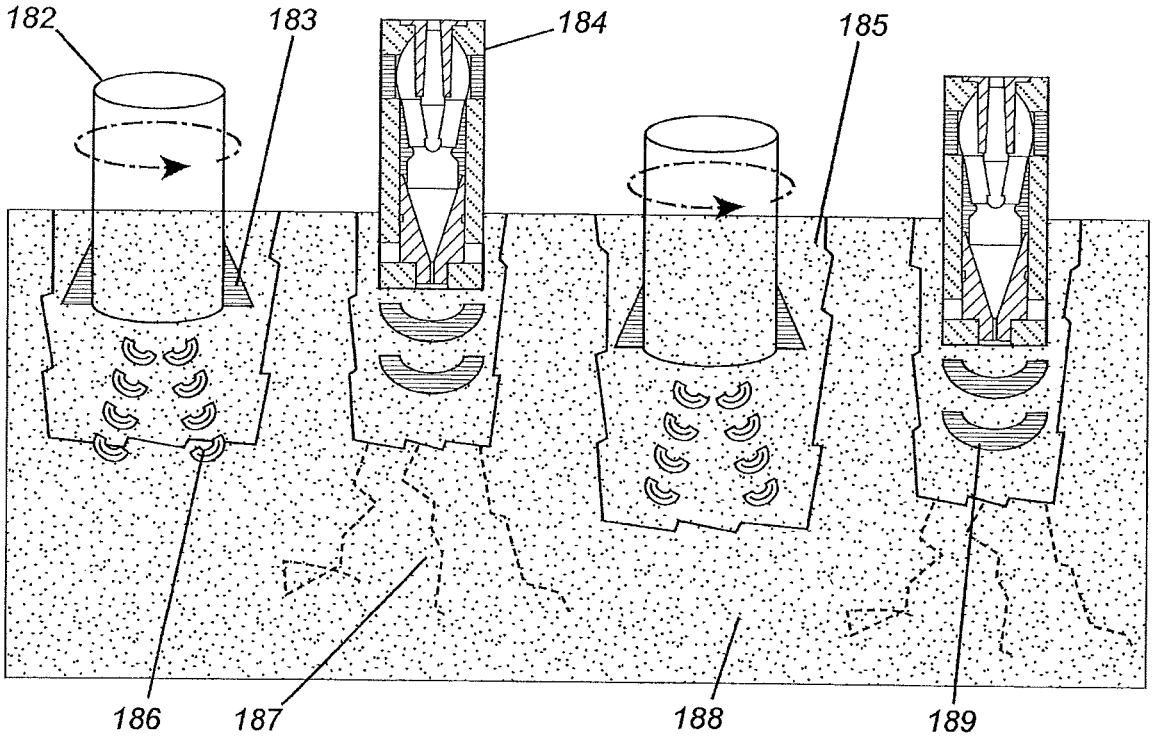
FIG. 33 is a drawing showing a hybrid system composed of an electrodischarge nozzle and the high-frequency pulsed waterjet for fragmentation of rocks and rock-like materials.

FIG. 33 is an illustration of a hybrid system implementing the low-frequency electrodischarge technique and ultrasonically modulated high-frequency pulsed waterjet (Vijay et al., "Ultrasonic Waterjet Apparatus," U.S. Pat. No. 7,594,614 B2, Sep. 29, 2009) for mining of minerals from hard rock formations 188 or similar applications without using environmentally harmful explosives. The method entails first drilling a hole 186 with the ultrasonic rotating nozzle 182. Some rock formations contain hard minerals such as quartz which are difficult to fracture just with the waterjet. However, such hard minerals being brittle can be easily broken by the carbide bits 183 sintered to the rotating nozzle body. When a certain depth of the hole has been obtained, then the electrodischarge nozzle 184 can be lowered into the hole full with water generating powerful shock waves, pulses and cavitation bubbles 189 resulting in fractures and microfractures in the rock formation 187. As such fractures weaken the rock formation, the hole diameter 185 and the rate of drilling would increase considerably enhancing the productivity. Thus, such a hybrid system would be extremely beneficial for mining of minerals or in other applications such as, for example, breaking the concrete biological shields in decommissioning operations of obsolete nuclear power stations.

The embodiments of the invention described above are intended to be exemplary only. As will be appreciated by those of ordinary skill in the art, to whom this specification is addressed, many variations can be made to the embodiments present herein without departing from the scope of the invention. The scope of the exclusive right sought by the applicant is therefore intended to be limited solely by the appended claims.

It is to be understood that the singular forms "a", "an" and "the" include plural referents unless the context clearly dictates otherwise. Thus, for example, reference to "a device" includes reference to one or more of such devices, i.e. that there is at least one device. The terms "comprising", "having", "including" and "containing" are to be construed as open-ended terms (i.e., meaning "including, but not limited to,") unless otherwise noted. All methods described herein can be performed in any suitable order unless otherwise indicated herein or otherwise clearly contradicted by context. The use of examples or exemplary language (e.g., "such as") is intended merely to better illustrate or describe embodiments of the invention and is not intended to limit the scope of the invention unless otherwise claimed.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the scope disclosed herein.

The invention claimed is:

1. An electrodischarge apparatus comprising:

a nozzle that includes a discharge chamber that has an inlet for receiving a liquid and an outlet aligned with the inlet such that the liquid flows in a same direction through the inlet and the outlet;

a first electrode extending into the discharge chamber;

a second electrode proximate to the first electrode to define a gap between the first and second electrodes;

a switch to cause an electrical discharge across the gap between the electrodes to create a plasma bubble which expands to form a shockwave that exits from the outlet; and a conically shaped movable reflector disposed at the inlet, the movable reflector being movable in the same direction to act as a check valve to admit the liquid into the discharge chamber and to reflect the shockwave generated by the discharge, wherein the movable reflector has a maximum diameter greater than the inlet, wherein the movable reflector has a diameter that increases in a downstream direction, wherein the movable reflector converges rearwardly into the inlet at an acute angle.

2. The apparatus of claim 1 wherein a downstream surface of the movable reflector is concave.

3. The apparatus of claim 1 wherein the inlet is larger than the outlet.

4. An electrodischarge apparatus comprising:

a nozzle that includes a discharge chamber that has an inlet for receiving a liquid and an outlet aligned with the inlet such that the liquid flows in a same direction through the inlet and the outlet;

a first electrode extending into the discharge chamber;

a second electrode proximate to the first electrode to define a gap between the first and second electrodes;

a switch to cause an electrical discharge across the gap between the electrodes to create a plasma bubble which expands to form a shockwave that exits from the outlet; and a conical movable reflector disposed upstream of the electrodes, the movable reflector being movable in the same direction to admit the liquid into the discharge chamber and to reflect the shockwave generated by the discharge, wherein the movable reflector has a maximum diameter greater than the inlet and wherein the movable reflector has a diameter that increases in a downstream direction, wherein the movable reflector converges rearwardly into the inlet at an acute angle.

5. The apparatus of claim 4 wherein a downstream surface of the movable reflector is concave.

6. The apparatus of claim 4 wherein the inlet is larger than the outlet.

7. An electrodischarge apparatus comprising:

a nozzle having an inlet and an outlet aligned with the inlet such that the liquid flows in a same direction through the inlet and the outlet;

a first electrode;

a second electrode, wherein the first and second electrodes define a gap between the first and second electrodes;

a switch to cause an electrical discharge between the electrodes to create an expanding plasma bubble that generates a shockwave; and a conically shaped movable reflector movable in the same direction to admit a liquid into the nozzle and to reflect the shockwave generated by the electrical discharge, wherein the movable reflector has a maximum diameter greater than the inlet and wherein the movable reflector has a diameter that increases in a downstream direction, wherein the movable reflector converges rearwardly into the inlet at an acute angle.

8. The apparatus of claim 7 wherein the movable reflector has a concave shaped downstream surface.

9. The apparatus of claim 7 wherein the inlet is larger than the outlet.

* * * * *